US007565755B2

(12) United States Patent
Tvoua et al.

(10) Patent No.: US 7,565,755 B2
(45) Date of Patent: Jul. 28, 2009

(54) PERSONALLY ADJUSTABLE FOOTWEAR

(75) Inventors: Ofer Tvoua, Rishon Lezion (IL); Amir Tvoua, Rishon Lezion (IL); Offer Canfi, lehavim (IL)

(73) Assignee: Peeerfect Fit LLC, New York, NY (US)

( * ) Notice: Subject to any disclaimer, the term of this patent is extended or adjusted under 35 U.S.C. 154(b) by 423 days.

(21) Appl. No.: 10/561,429

(22) PCT Filed: Oct. 26, 2005

(86) PCT No.: PCT/IL2005/001117

§ 371 (c)(1),
(2), (4) Date: Dec. 19, 2005

(87) PCT Pub. No.: WO2006/046241

PCT Pub. Date: May 4, 2006

(65) Prior Publication Data

US 2007/0251126 A1 Nov. 1, 2007

(30) Foreign Application Priority Data

Oct. 27, 2004 (IL) ..... 164853

(51) Int. Cl.
*A43B 3/26* (2006.01)

(52) U.S. Cl. ..... 36/97; 36/11.5

(58) Field of Classification Search ..... 36/97, 36/7.1 R, 7.5, 7.6, 7.7, 100, 11.5, 102
See application file for complete search history.

(56) References Cited

U.S. PATENT DOCUMENTS 524,946 A 8/1894 Kregel
641,642 A 1/1900 Gunn
1,633,413 A 6/1927 La Marca
2,009,684 A 7/1935 Affronte
2,112,052 A * 3/1938 Smith ..... 36/97
2,497,175 A 2/1950 Mantos
2,523,449 A 9/1950 Rosenzweig
2,947,095 A 8/1960 Miyachi
2,952,925 A 9/1960 Held
D189,522 S 1/1961 Miyachi
3,389,481 A 6/1968 England (Continued)

FOREIGN PATENT DOCUMENTS

GB 2 242 344 A 2/1991

OTHER PUBLICATIONS

Marie Patterson; International Search Report in PCT/IL05/01117; Aug. 2, 2006; USPTO; Alexandria, Virginia.

(Continued)

*Primary Examiner*—Marie Patterson
(74) *Attorney, Agent, or Firm*—Hedman & Costigan, P.C.

(57) ABSTRACT

Personally adjustable footwear with at least one sole layer including: a toe portion, a heel portion, and an intermediate portion. The intermediate portion has openings passing vertically through the layer so that the intermediate portion is elastically flexible to allow relative longitudinal displacement of the toe portion and the heel portion to vary a length of the layer without significant variation in a thickness of the layer. A retention mechanism selectively fixes the toe and heel portions in any of a number of relative positions. Also disclosed are implementations with insertable and removable segments, and with elongated elements sliding in channels.

42 Claims, 16 Drawing Sheets

U.S. PATENT DOCUMENTS

| | | | | |
|---|---|---|---|---|
| 3,436,842 | A | 4/1969 | Sachs | |
| 3,698,107 | A | 10/1972 | Fukuoka | |
| 3,997,985 | A | 12/1976 | Shiina | |
| 4,114,296 | A * | 9/1978 | Smith | 36/101 |
| 4,120,103 | A | 10/1978 | Colby | |
| 4,290,211 | A | 9/1981 | Csengeri | |
| 4,727,662 | A | 3/1988 | Ilon | |
| D332,515 | S | 1/1993 | Middleton | |
| D332,516 | S | 1/1993 | Middleton | |
| 5,265,349 | A | 11/1993 | Munschy | |
| 5,570,523 | A | 11/1996 | Lin | |
| 5,659,980 | A | 8/1997 | Lin | |
| 5,666,746 | A * | 9/1997 | Pollard | 36/135 |
| 5,682,687 | A | 11/1997 | Arai | |
| 5,966,840 | A | 10/1999 | Bell et al. | |
| D419,283 | S | 1/2000 | Coito | |
| 6,138,385 | A | 10/2000 | Jungkind | |
| 6,237,255 | B1 | 5/2001 | Renaudin et al. | |
| 6,374,515 | B1 | 4/2002 | Davis | |
| 6,438,872 | B1 | 8/2002 | Chil et al. | |
| 6,574,888 | B2 | 6/2003 | Miller et al. | |
| 6,701,643 | B2 | 3/2004 | Geer et al. | |
| 6,742,286 | B2 | 6/2004 | Giovale | |
| D528,746 | S | 9/2006 | Belley et al. | |
| 2002/0178617 | A1 | 12/2002 | Chil et al. | |
| 2003/0106244 | A1 | 6/2003 | Miller et al. | |
| 2003/0192204 | A1 | 10/2003 | Miller et al. | |
| 2004/0107604 | A1 * | 6/2004 | Ha | 36/97 |
| 2004/0211090 | A1 * | 10/2004 | Miller et al. | 36/97 |
| 2005/0050772 | A1 * | 3/2005 | Miller et al. | 36/97 |
| 2005/0055849 | A1 * | 3/2005 | Ha | 36/97 |
| 2005/0060913 | A1 * | 3/2005 | Chil et al. | 36/97 |
| 2005/0115113 | A1 * | 6/2005 | Miller et al. | 36/97 |
| 2005/0115114 | A1 * | 6/2005 | Miller et al. | 36/97 |
| 2006/0130371 | A1 * | 6/2006 | Schneider | 36/97 |
| 2007/0011916 | A1 * | 1/2007 | Olivieri | 36/97 |

OTHER PUBLICATIONS

Simin Baharlou; International Preliminary Report on Patentability in PCT/IL05/01117; May 1, 2007; International Bureau of WIPO; Geneva, Switzerland.

Marie Patterson; Written Opinion of the International Searching Authority in PCT/IL05/01117; Jul. 17, 2006; USPTO; Alexandria, Virginia.

* cited by examiner

PERSONALLY ADJUSTABLE FOOTWEAR

FIELD OF THE INVENTION

This invention relates to footwear, particularly footwear whose size is adjustable.

The term "footwear" when used herein, is to be taken in its broadest sense and denotes shoes, sneakers, sandals, clogs, boots, skates, sportswear for the foot, etc.; and any of these terms may be substituted herein for the term "footwear".

BACKGROUND OF THE INVENTION

There is known in the art shoes whose longitudinal dimension is adjustable by a variety of ways.

U.S. Pat. No. 524,946 (Kregel) discloses a shoe intended for fitting to a deceased person for viewing and interment. Adjustability is achieved using an elastic band extending between a heel portion and toe portion designed to draw the heel portion forward to snuggly fit to the foot of the deceased.

U.S. Pat. No. 641,642 (Gunn) discloses a shoe, being adjustable length-wise and width-wise, the sole of which comprises a frame part at the shoe's heel and a shank at the middle/front of the sole. The frame part and shank are slidable with respect to one another to the extent of a slot in the shank. Upon adjusting to a desired length, the length of the sole is fixed by tightening a screw. The shoe comprises an upper, or top portion, designed to accommodate inserts on the right and left sides thereof, which can be folded to allow adjustment of the top portion of the shoe. The insert is secured by a lacing cord which passes between two vertical rows of eyelets. A similar arrangement is used to adjust the width of the shoe, with laterally arranged slots.

U.S. Pat. No. 2,009,684 (Affronte) describes a shoe, having a similar length adjusting means wherein the shank has a tongue being slidable within a receiving portion of the heel section of the sole. The tongue has a plurality of holes for allowing a screw to pass and fix the tongue to the heel section at a hole corresponding to the desired shoe length.

U.S. Pat. No. 2,497,175 (Mantos) provides a shoe formed of two main sections designed to be joined together by workmen in the shop of a shoe dealer whereby the size of the shoe can be adjusted to a given size prior to completing assembly of the shoe. A metal shank projecting from the toe section of the sole comprises an integral fork aligned with a metal sheath or plate mounted in the heel portion of the sole. The fork has tines with triangularly shaped lugs along their edges corresponding to receiving members on the sheath to allow the toe and heel sections of the shoe to be securely attached to produce a shoe having any number of discrete lengths.

U.S. Pat. No. 3,389,481 (England) shows an expandable shoe having a mid-section of bellows-like material permitting longitudinal expansion and contraction along a sliding guide having a locking mechanism to secure the fit at a desired length. The locking mechanism comprises a metal shank having two sliding plates, one of which has a transverse slot for receiving a detent formed in the other plate. A screw assembly extending up though the heel is removed to allow the plates to slidable over one another, and then it is reinserted to retain the shoe in the newly extended position.

U.S. Pat. No. 3,997,985 (Shina) discloses a stretchable shoe, particularly suitable for a growing child, comprising a front member and a rear member which may be adjusted in length. The front member and the rear member are separable and inter-connected by a screw which passes through one hole of the front member and one of a plurality of holes of the rear member. The front member is composed of an upper, an insole, a middle plate and a bottom plate, and the rear member is composed of a sole, an upper and a heel.

U.S. Pat. No. 5,659,980 (Lin) discloses an adjustable shoe which has a heel, a toecap and an insole. The front portion of an instep has a plurality of positioning protrusions. First and second fastening pads are disposed on two outer sides of the heel. First and second ball buttons are disposed on the rear surface of the heel. An adjustable pad with positioning holes therein is disposed on the toecap from which two flaps extend. The inner surface of the flap has a fastening element. The first and second positioning plates are extended from the back of the outsole. The first positioning plate holds the first socket button and the second positioning plate holds the second socket button.

U.S. Pat. No. 6,138,385 (Jungkind) describes a shoe sole having a jointed middle section located between toe and heel portions of the sole. The middle section is made of an elastically flexible of springy material configured as a wavy or folded web with crests and troughs. A spindle runs from the heel to the toe portions and has a head located inboard of the rear edge of the heel portion. The spindle is rotatable/screwable into a nut whereby the shoe can be adjusted in length.

It is an object of the present invention to provide footwear whose size can be adjusted by the wearer. It is a further object of the invention to provide such adjustable footwear which is personalizable and easily and quickly re-adjustable.

SUMMARY OF THE INVENTION

The present invention relates to footwear whose size can be conveniently and easily adjusted without any need for tools.

Such footwear typically comprises a toe portion (hereinafter "toe"), a heel portion (hereinafter "heel"), composing a sole and may also include a top portion or so-called upper.

According to one embodiment of the invention, the footwear comprises a series of sole segments (laterally oriented, longitudinally oriented, or a combination thereof) disposed between the toe and the heel. These segments can be added or removed to adjust the size of the footwear; or, they may be spaced further apart or closer together to adjust the footwear size.

Each of the segments comprises an arrangement allowing them to be fixed between the toe and heel. One option for such an arrangement is by having at least one, and typically two or more, parallel bores which are oriented to run longitudinally to the footwear while extending from the toe toward and into the heel, or vice versa, there are one or more segment holding members (e.g. rod-like members, cables, tongue-like member(s), etc.) adapted to be aligned with the bores of the segments and with corresponding bores in the heel (or toe, if vice versa). The segment holding members may be fairly rigid, however with appropriate resiliency/flexibility to allow for suitable movement when the footwear is being worn; however, they may be stretchable, for example, rubber band-like members. Depending upon the option, the heel or toe may comprise a locking mechanism, which would be appropriate, for example, to an embodiment comprising rod-like members extending between the toe and heel.

Segments adapted for this option are typically in the shape of a bar with a square profile, however, they may be of any of a variety of shapes, styles, colors, shapes, etc., and include aesthetic ornamental or artistic features so that the wearer can modify the style of the footwear to his or her taste—as may segments usable in other options, described below.

Another option for fixing segments between the toe and heel is by their being adapted to inter-engage or inter-connect with each other and to engage with the toe and heel. Inter-engaging may be by a variety of arrangements, including "Lego™-type" connections, snap-fitting, screw-fitting, twist-fitting, hooking, hook and loop fasteners (Velcro™), etc.

According to another embodiment of the invention, the footwear comprises toe and heel portions connected therebetween by a bellows-like structure, constituting a middle section, being compressible and/or expandable at least in the direction longitudinal to the footwear.

Projecting from the toe is a tongue that extends into a corresponding tongue receptacle in the heel, or vice versa. The tongue comprises a plurality of linearly arranged holes passing therethrough and alignable with corresponding to holes in the tongue receptacle. The heel comprises a top portion which can be bent upward and having a plurality of downward projections or pegs adapted to pass through the holes of the tongue and into the bores/depressions of the tongue receptacle. The size of the footwear can be adjusted by lifting the top portion and sliding the toe and the heel toward each other, or apart, until a size, corresponding to an alignment of the holes of the tongue and tongue receptacle is achieved. The top portion is then lowered to fix the length.

Optionally, the footwear can include an arrangement for facilitating alignment of the pegs and corresponding bores. Further, the tongue may comprise an indicator to point to indicia adjacent the tongue receptacle which indicates the size of the shoe at a given adjustment portion.

According to an additional embodiment of the present invention, the footwear's toe and heel each comprise members (e.g. finger-like members, typically in a male/female connection) which extend toward and engage with each other. The members are slidable with respect to each another to allow for different footwear length, and typically have profiles shaped in such a way as to prevent vertical displacement.

At a desired length, a tongue with at least one extending peg/projection can be inserted into a tongue receptacle at the heel.

Thus, the present invention provides footwear whose size can be conveniently and easily adjusted without any need for tools, possibly by a wearer thereof. The footwear according to embodiments of the invention is readjustable, thus it can be adjusted to a variety of lengths at any time.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF THE INVENTION

Figure 1:
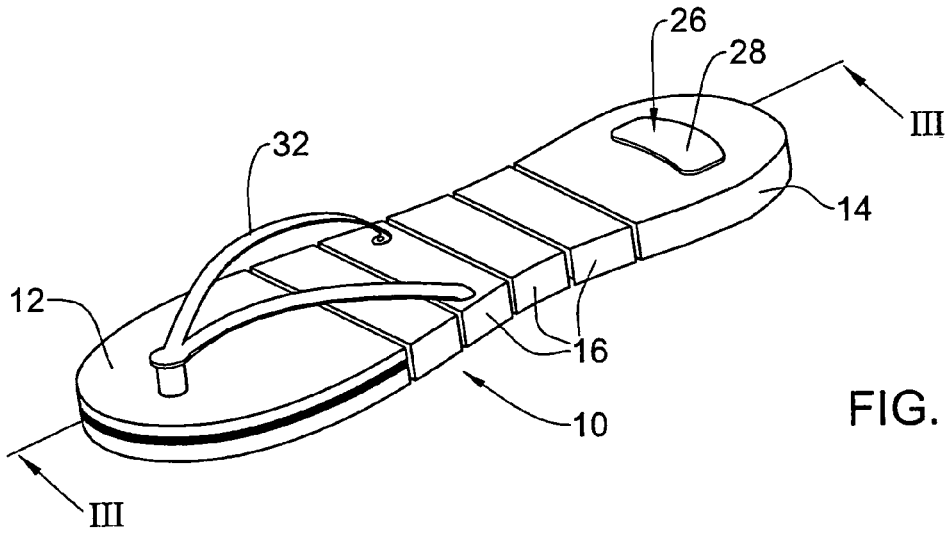
FIG. 1 is a perspective view of an embodiment of adjustable footwear according to the present invention.
Figure 2:
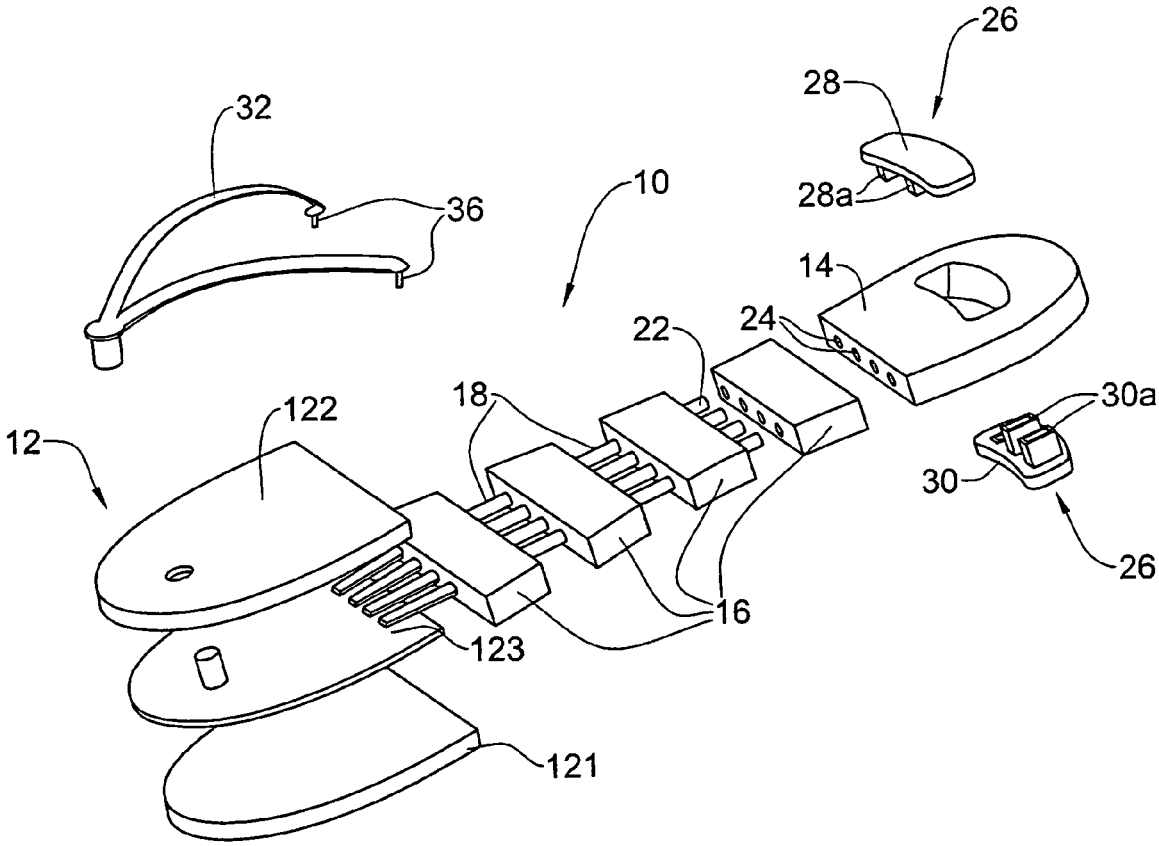
FIG. 2 is an exploded view of the embodiment shown in FIG. 1.
Figure 3A:
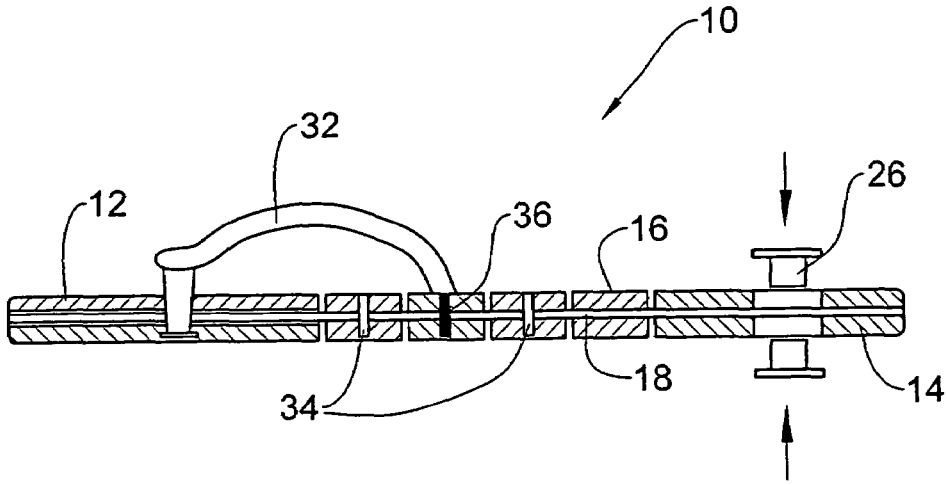
FIG. 3A is a longitudinal sectional view along line III-III in FIG. 1.
Figure 3B:
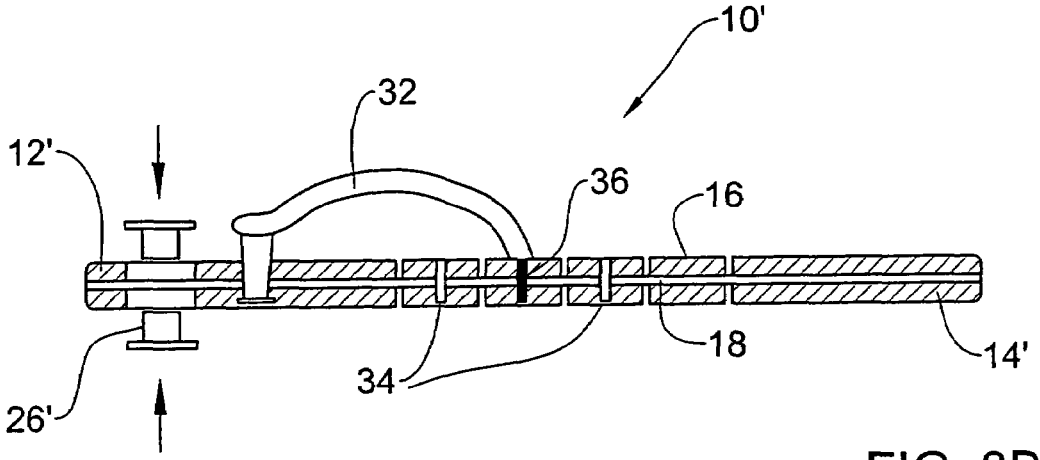
FIG. 3B is a sectional side view of a modification of the embodiment of FIGS. 1-3.

Referring to FIGS. 1-5, a first embodiment, including particular modifications, of an article of footwear, generally designated as 10, of the present invention, is illustrated. The footwear 10 comprises a toe portion 12 (hereinafter "toe") and a heel portion 14 (hereinafter "heel") and a plurality of segments 16 disposed therebetween. Extending from the toe 12 toward the heel 14 is at least one (and typically more than one) segment holding member in the form of a rod-like member—for example, four rods 18 as illustrated in FIG. 2.

The segments 16 typically have a geometry wherein they have a length and a width, the length being longer than the width—in other words an aspect ratio greater than one. The segments 16 may comprise an indication of their size, in particular the dimension affecting the length of the footwear 10. Such an indication may be a numeral thereon indicating its dimension, or a color, shape, decoration, etc., corresponding to a dimension. However, the segments 16 may be of various shapes, colors, etc., merely for decorative purposes. The segments 16 may also be made of different materials for functional (e.g. wear-strength, comfort) and/or decorative purposes.

The segments 16 have essentially horizontal holes or bores 20 (best seen in FIG. 4) adapted so that the rods 18 can pass therethrough. For this purpose, at least some of the segment's bores 20 are alignable with each other. In this manner, the segments 16, which constitute a middle portion of the sole of the footwear, can be incorporated into the sole or removed therefrom whereby the size of the footwear 10 is adjustable.

The heel 14 also has holes or bores 24 being alignable with the rods 18 and thus alignable with at least some of the bores 20 in the segments 16. The heel's bores 24 are adapted to receive the rods 18 (i.e. free ends 22 thereof). The rods 18 extend into the heel 14 where they are fixed in place by a locking mechanism 26.

The locking mechanism 26 comprises, for example, a top portion 28 and a bottom portion 30, at least one or the other of the portions adapted to hold or clamp the rods 18 in place. Typically, the portions 28 and 30 are designed to be engageable with each other, in any known manner. For this purpose, the portions 28 and 30 may have engagement members 28*a* and 30*a*, respectively.

In order to adjust the size of the footwear 10, the locking mechanism 26 is disengaged allowing the heel 14 to be slid back away from the toe 12 whereby it is removed from the rods 18. Then, segments 16 are added or removed to increase or decrease the length of the footwear 10. The heel 14 is then replaced, and then the locking mechanism 16 is reaffixed.

To further accommodate such adjustment, if the footwear 10 is a sandal or "flip-flop" or "thong" type, wherein it typically incorporates a toe-strap 32, the positioning of said toe-strap 32 may be altered. For this purpose, at least some of the segments 16 may further comprise (essentially) vertical bores 34 (FIGS. 3A, 3B and 4) adapted to receive attachment projections 36 of the toe-strap 32 which can be attached (fixed in place) by any known means.

As understood from the exploded view of the footwear 10 in FIG. 2, the toe 12 can be composed of layers, for example an outsole layer 121, an insole layer 122 and an intermediate layer 123. Such a design may be convenient for manufacturing and allow for portions/layers of different characteristics. For example, the outsole layer 121 may be made of a wear resistant material for increasing the life of the footwear 10 and the insole layer 122 may be made of a relatively soft or compliant material for comfort of a wearer.

Figure 4:
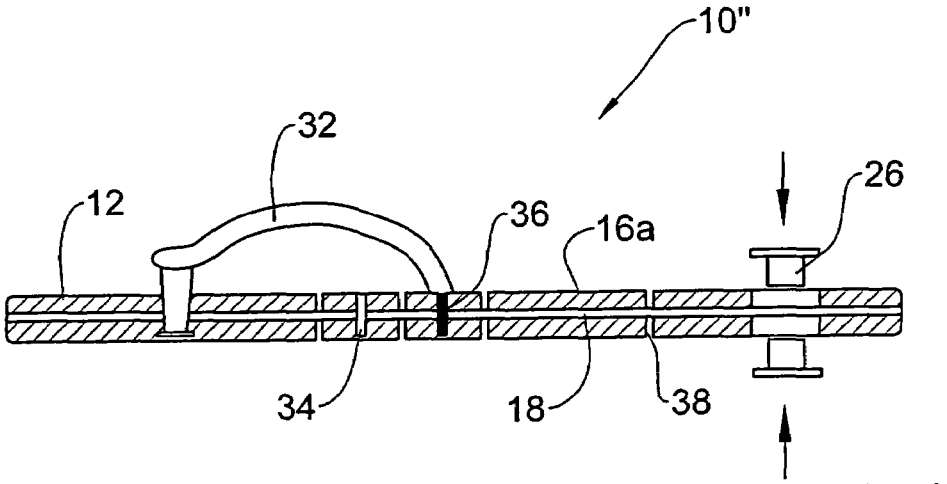
FIG. 4 is a longitudinal sectional view showing another modification to the embodiment shown in FIG. 1.

FIG. 4 illustrates an article of footwear 10" being a modification of that described with reference to the preceding figures. Here, the footwear 10" comprises at least some segments 16*a* having at least one transverse bore 38; best seen in FIG. 5A. A segment 16*b* shown in FIG. 5A illustrates the possibility of the segment having both bores like bores 20 and like bore 38; thereby providing different options for achieving a given footwear length as well as a particular aesthetic aspect (e.g. different colors on each face of the segment) or flexibility thereto.

Figure 5A:
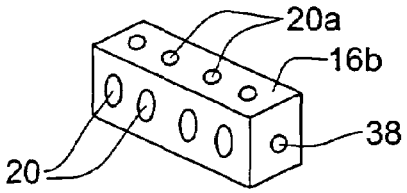
FIG. 5A is a perspective view of a segment usable in any of the embodiments of FIGS. 1-4.

Additionally, the segments 16*b* could include bores 20*a* essentially perpendicular to bores 20 such that the segment could be incorporated in the footwear 10 rotated a quarter turn/rotation to that shown in FIG. 5A. This feature could have advantages in situations, for example, where any of the segments 16*b* have designs thereon or are shaped in a way that the overall design of the footwear can be changed (by turning/rotating segments), thereby giving the wearer the option to "self-design" the footwear to his/her taste. Bore 38 also provides flexibility in this regard.

It should be understood that the heel 14 could be designed in a manner analogous to that just described with respect to the toe 12, and vice versa. In other words, referring now to FIG. 3B, there may be footwear 10' of the present invention wherein the rods 18 extend from a heel 14' toward a toe 12' and being locked in place by a locking mechanism 26' at the toe 12', mutatis mutandis.

It should also be noted that rather then providing several extension segments 16, there may be provided one or more segments, the length of which may be predetermined or be set to suit an individual's foot size, e.g. by trimming the length of such segments.

FIGS. 5B-5I illustrate various examples of segments which may be used in adjustable footwear according to further embodiments of the present invention. The segments shown in these figures do not require a segment holding member (rod, tongue, cable, elastic, etc.) rather instead they comprise inter-engaging or inter-corresponding members, typically male-female type engagement elements.

Figure 5B:
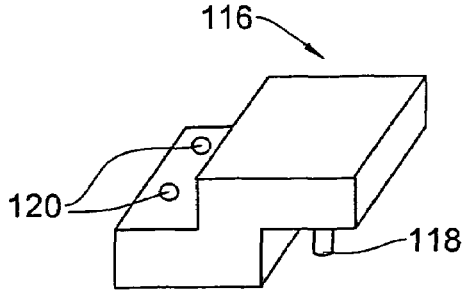
FIGS. 5B-5J are perspective views of segments for use in further embodiments of adjustable footwear of the present invention.

In FIG. 5B there is shown a segment 116 having a "Lego™-type" configuration. Thus, it has projections 118 (only one is seen) and indentations 120 which are designed to correspond to indentations and projections of other similarly configured segments. Naturally, a toe and heel of footwear used in an embodiment shown in FIG. 5B would also have corresponding projections or indentations, as the case may be, so that the segments 116 could be suitably joined thereto. It should be understood that this latter situation is the same for all of the segments described in FIGS. 5B-5I, and therefore this fact shall not be repeated.

Figure 5C:
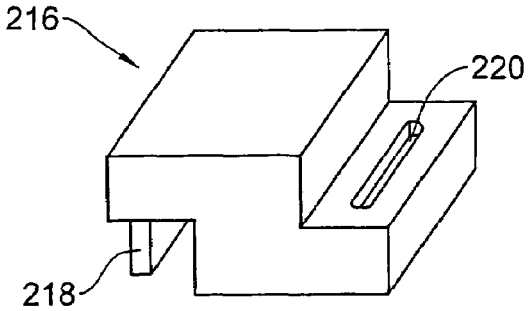

In FIG. 5C there is shown a segment 216 being similar to segment 116 of FIG. 5B, however it comprises an elongated projection 218 and a slotted indentation 220—again, designed to correspond to an indentation and projection of other similarly configured segments.

Figure 5D:
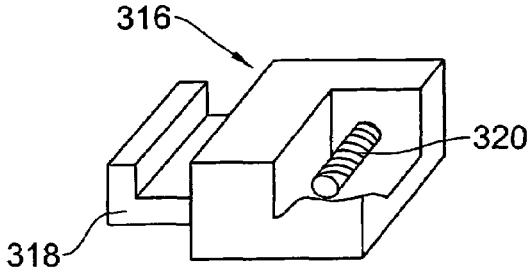

In FIG. 5D there is shown a segment 316 comprising a wide hook-shaped projection 318 and a rod 320. For illustration purposes, the segment 316 is shown with a partial cutaway in the area of the rod 320 and typically the rod 320 would be attached to the rest of the segment at both its ends to provide strong support. To join such segments 316 with each other, one segment is angled to allow the hook-shaped projection 318 to be slid under the slotted indentation 320 of another segment, and then it is arranged to be flush to that other segment.

Figure 5E:
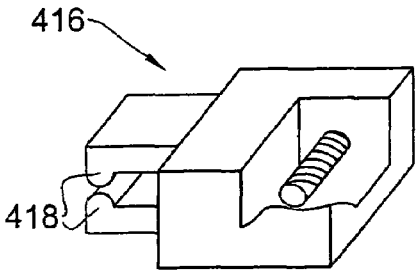

FIG. 5E presents a segment 416 being similar to segment 316 of FIG. 5D, however it comprises a pair of resilient projections 418 that can inter-engage with a rod 420. Again, for illustration purposes, the segment 416 is shown with a partial cutaway in the area of rod 420. To join such segments 416 with each other, one segment is pushed toward another segment causing the projections 418 to first open when nubs 422 of the projections 418 contact the rod 420 of another segment, and then to close around the backside of the rod 420 in a snap-fit manner.

Figure 5F:
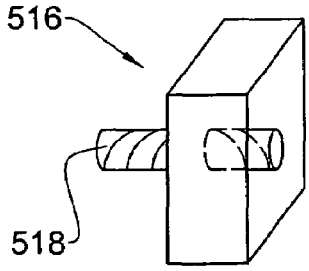

FIG. 5F shows another segment 516 connectable to like segments; as above. Here, the segment 516 comprises a screw-like projection 518 that can inter-engage with a threaded indentation 520. To join such segments 516 with each other, one segment is simply turned so that its screw-like projection 518 screws into the threaded indentation 520 of another segment.

Figure 5G:
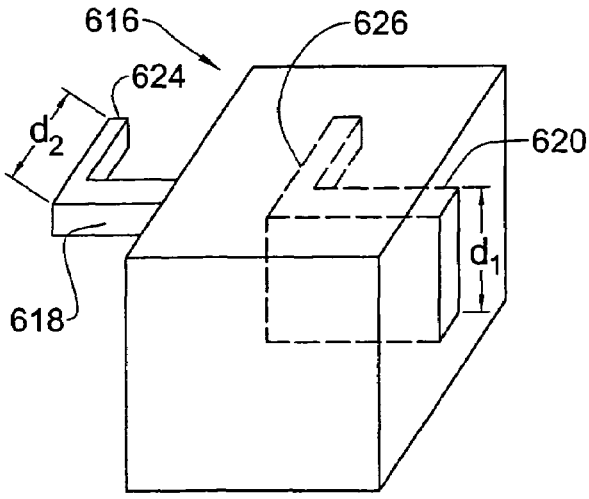

FIG. 5G shows yet another example of a segment 616 connectable to like segments. Here, the segment 616 comprises a projection, for example an L-shaped projection 618 that can inter-engage with a corresponding indentation 620. The indentation 620 comprises a slot 622 and the projection comprises an arm 624, the slot having a length dimension d1 typically being a bit longer than a length dimension d2 of the arm 624 of the L-shaped projection 618.

To join such segments 616 with each other, a first segment is turned 90° so that its L-shaped projection 618 fits into the slot 622 of the other segment, then the first segment is pushed flush to the other segment, and lastly it is turned 90° so that the arm 624 enters an arm-receiving cavity 626 of the indentation 620.

Figure 5H:
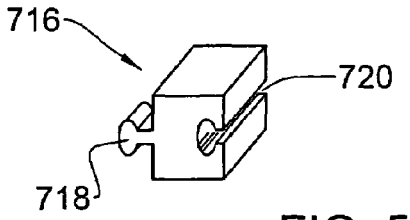

FIG. 5H shows yet a further example of a segment 716 connectable to like segments. Here, the segment 716 is a puzzle-like piece and comprises a projection 718 adapted to fit into an indentation 720 by either sliding transversely or by a pressure/snap fitting method.

Figure 5I:
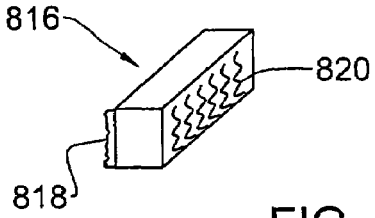

FIG. 5I provides an embodiment showing another example wherein segments are inter-connected. Here, segments 816 (only one shown) have hook and loop fasteners (Velcro™) 818 and 820 adhered to their sides whereby they can attach one to the next.

Figure 5J:
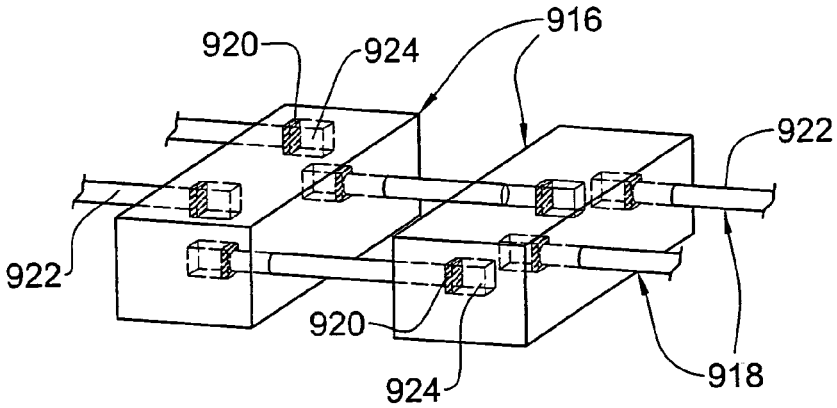

FIG. 5J illustrates another embodiment wherein segments are inter-connected. However, in this case there are segments 916 that remain connected while being movable in relation to each other in that they can be spaced apart, to various degrees, or be positioned adjacent each other. This option can be accomplished, for example, as seen in FIG. 5I.

The segments 916 have segment connecting members 918, for example nail-shaped members having a head 920 and a stem 922. The segments 916 comprise cavities 924 (shown with dashed lines) within which the heads 920 and a portion of the stems 922 are located; these also being shown with dashed lines where they are internal to the segments 916. The cavities 924 are shaped such that the connecting members 918 can be slid back and forth whereby the segments 916 may be positioned closer or farther from each other.

To fix the distance, the cavities 924 are adapted to fairly snugly hold the connecting members 918, or the segments 916 may be held in place by one of several alternate methods (e.g. such as described below).

Figure 6:
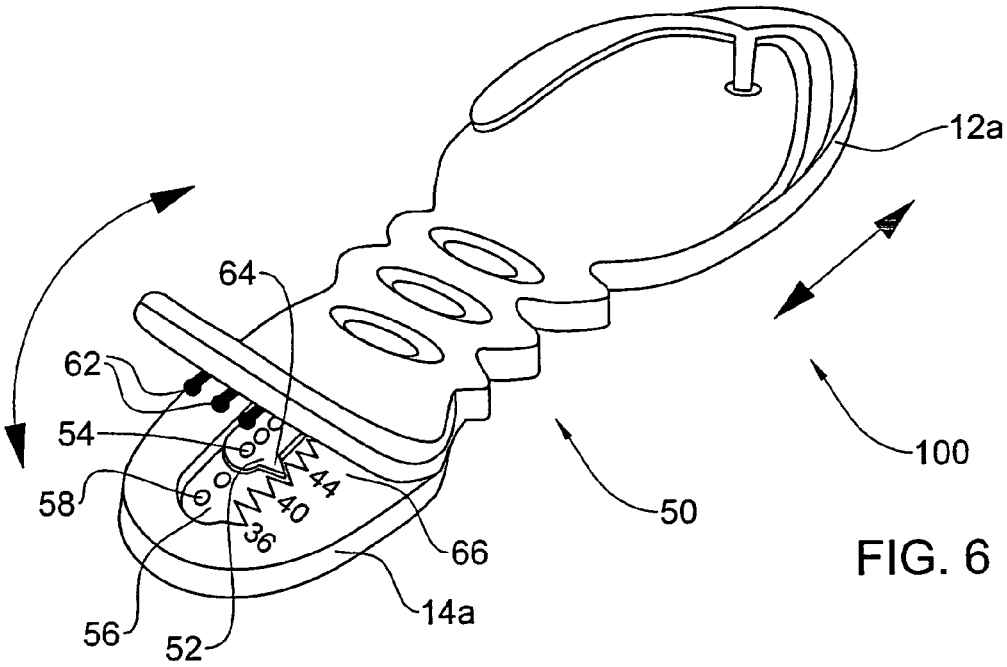
FIG. 6 is a perspective view of another embodiment of the present invention.
Figure 7:
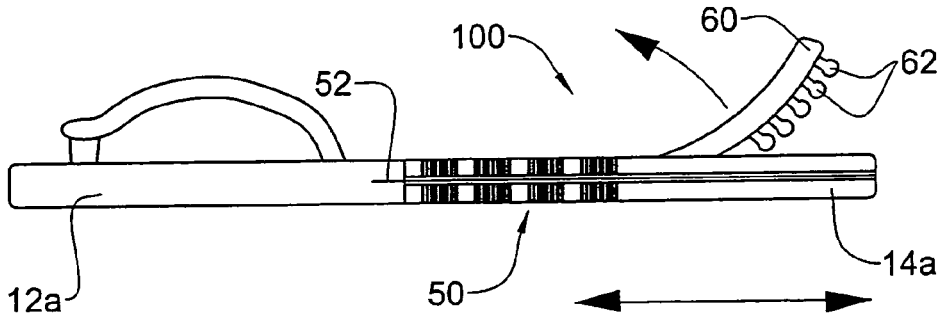
FIG. 7 is a longitudinal sectional view of the embodiment shown in FIG. 6.

FIGS. 6 and 7 illustrate another embodiment of the present invention, providing an article of footwear, generally designated as 100. Here, disposed between a toe 12*a* and a heel 14*a* is a flexible bellows-like structure 50 which connects the toe and heel and provides size flexibility to the footwear 100.

The toe 12*a* has a tongue 52, which may be integral therewith or attached thereto, adapted to be slidable through a passage (not seen) in the bellows-like structure 50. The tongue 52 comprises a plurality of through-holes 54 being collinear and typically equally spaced apart. The heel 14*a* comprises a tongue receptacle 56 having depressions 58 corresponding, and similarly spaced, to holes 54.

The heel 14*a* comprises a top portion 60 adapted to be upwardly bendable, exposing the tongue receptacle 56. The top portion 60 includes at least one downwardly projecting peg-like member 62, arranged, and of a size, to pass through the tongue's holes 54 and be engagedly receivable in the depressions 58 of the tongue receptacle 56, for example, in a snap-fit type manner.

To adjust the size of the footwear 100, the heel's top portion 60 is lifted (illustrated by dashed lines in FIG. 7), thereby decoupling the peg-like members 62 from the depressions 58 and lifting them out from the holes 54. The toe 12*a* and the heel 14*a* are then slid toward or away from each other to respectively decrease or increase the length of the footwear 100. This may entail compressing or expanding the bellows-like structure 50 for which purpose it is made of a flexible, resilient material.

When a desired length is achieved, within the tolerance of the distance between the spaced-apart holes 54, the size of the footwear 10 can be fixed. This is accomplished by aligning the tongue's holes 54 with the tongue receptacle depressions 58 and closing the heel's top portion 60 downward to recouple the peg-like members 62 with the depressions 28.

Optionally, there may be provided a marker 64, such as an arrow or projection, associated with the tongue 52, along with indicia 66 adjacent the tongue receptacle 56, for indicating a shoe size. This marker/indicia arrangement may also be useful for making it easier to align the tongue's holes 54 with tongue receptacle's depressions 58; for example, by means of a projection/socket (male/female component) arrangement for ensuring alignment.

It should be understood that the function provided by the heel's top portion 60 could alternatively be provided by a bottom portion thereof or even by a top or bottom portion of the toe 12*a*, mutatis mutandis.

Figure 8:
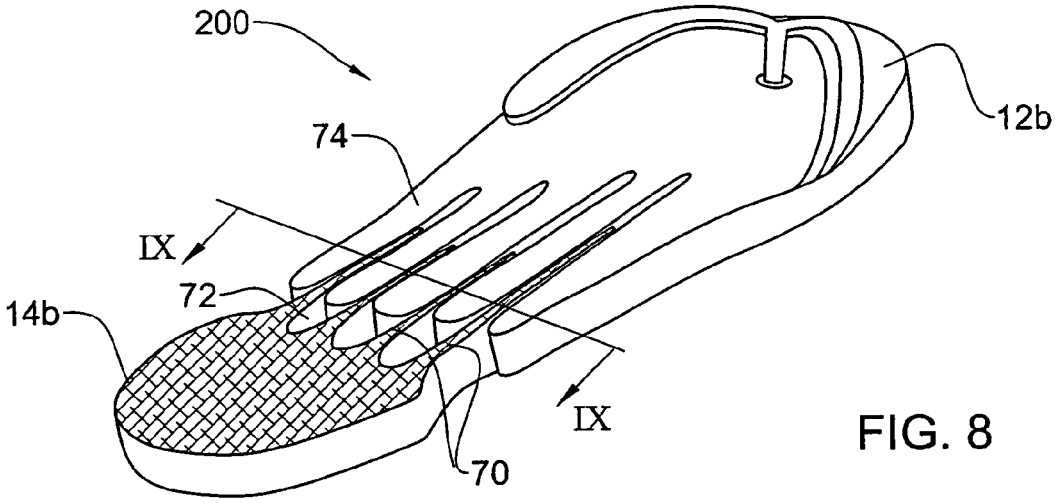
FIG. 8 is a top perspective view of a further embodiment of the present invention.
Figure 9A:
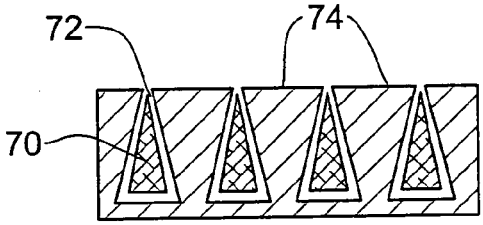
FIG. 9A is a sectional view taken through plane IX-IX of FIG. 8.
Figure 9B:
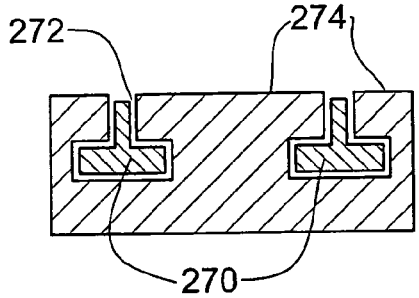
FIG. 9B is a sectional view analogous to that of FIG. 9A illustrating an exemplary modification of the embodiment shown in FIG. 8.
Figure 10:
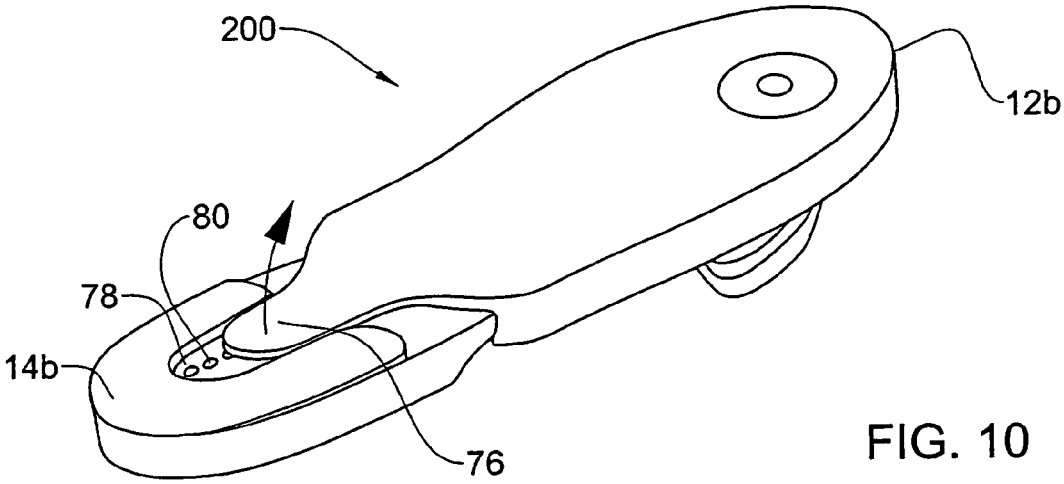
FIG. 10 is a bottom perspective view of the embodiment shown in FIG. 8.

According to a further embodiment of the present invention, illustrated in FIGS. 8-10, there is an article of footwear 200 comprising elongated projections 70 extending from a heel 14*b* toward a toe 12*b* thereof. The profile of the projections 70 (FIG. 9A) corresponds to channels 72 in an elongated projection receiving portion 74 projecting from the toe 12*b*.

The heel's projections 70 are slidable toward and apart from the receiving portion 74. It should be noted however that the profile of the projections 70, in combination with the shape of the receiving portions channels 72, are of a geometry whereby the members are prevented from significantly sliding with respect to each other in the vertical direction. This is a much preferred situation for since it would otherwise be potentially inconvenient or uncomfortable to the wearer. It should be understood that many other profile/shape combinations are possible which would prevent such unwanted vertical displacement.

FIG. 9B illustrates one example of the many alternative interacting configurations for elongated projections and corresponding channels of a projection receiving portion. In this example, the projections are inverted T-shaped elongated projections 270, which are engagable in correspondingly shaped channels 272 with a projection receiving portion 274. It should be understood that such projections may be any of a variety of profiles in addition to those described above, e.g. L-shaped, bulb-shaped, J-shaped, Y-shaped, anchor-shaped, cross-shaped, and the like.

Appropriate design of the exemplary projections 70, 270 and channels 72, 272, respectively, can allow the footwear 200 to be adjusted to a desired length and remain at such while it is worn, for example, via a pressure or friction inter-fitting of the projections and receiving portions. However, the footwear 200 typically will include an auxiliary locking arrangement, such as that now described.

An example of such a locking arrangement is shown in FIG. 10, wherein extending from the toe 12*b* toward the heel 14*b* is a tongue 76 which comprises at least one peg-like member projecting therefrom. The peg-like member is not visible, however it can be of a form similar to that described above with reference to FIGS. 6 and 7. The heel 14*b* comprises a tongue receptacle 78 comprising a plurality of depressions 80 which are adapted to receive the at least one peg-like member.

The size of the shoe can be adjusted by removing the tongue 76 from the tongue receptacle 78, sliding the toe and the heel apart or together—corresponding to the desired footwear size—and then reengaging the tongue 76 and the tongue receptacle 78 (i.e. pressing the peg-like structure into a/the depression(s)).

Once again, it should be understood that heel/toe (i.e. projections/receiving portion) could be arranged conversely and that the tongue could be disposed at either of the top or bottom of the sole of the footwear and could alternatively extend from the heel 14*b*, mutatis mutandis.

Figure 11:
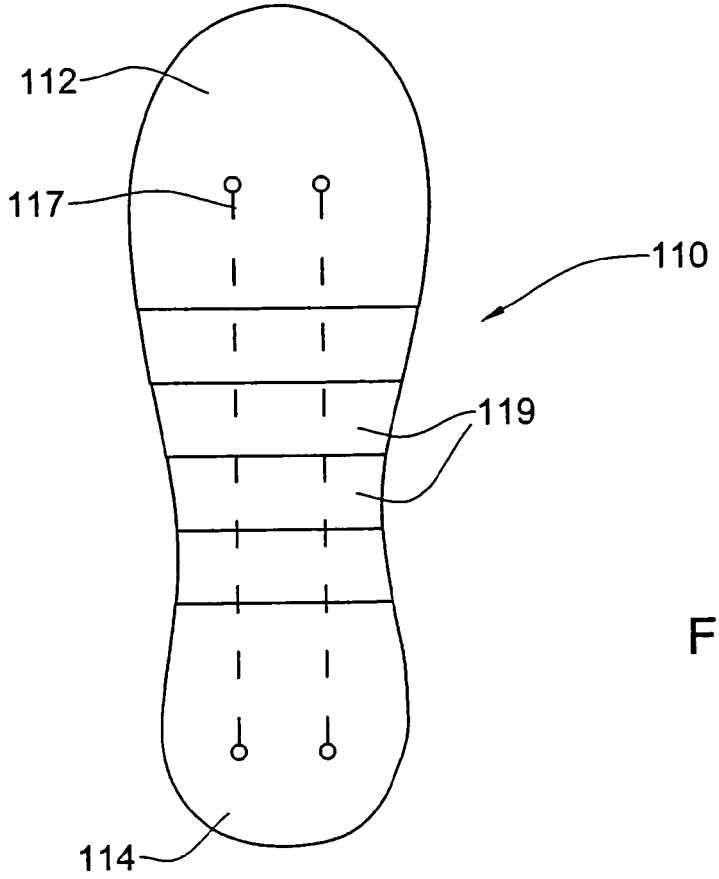
FIG. 11 is a bottom view of a modification of the embodiment of FIG. 1.

FIG. 11 shows a modification of the embodiment of FIG. 1 where there is footwear 110 wherein extending between a toe 112 and a heel 114 is at least one, typically more than one, segment holding member in the form of a stretchable member or elastic member 117 (two shown) running through segments 119 (therefore shown by dashed lines). The segments 119 can be added or removed upon pulling the toe 112 and heel 114 apart and the segment(s) is then fitted on the elastic member 117 or removed therefrom, respectively.

Figure 12A:
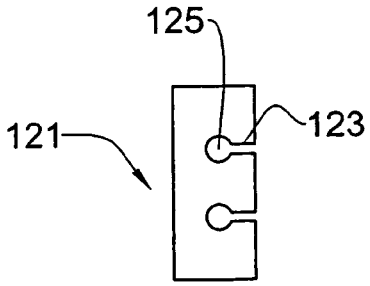
FIG. 12A-12C are side views of exemplary segments for use in the embodiment of FIG. 11.
Figure 12B:
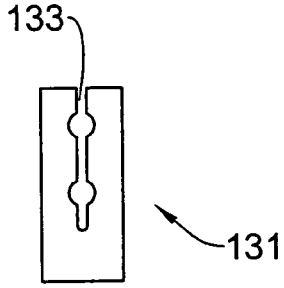
Figure 12C:
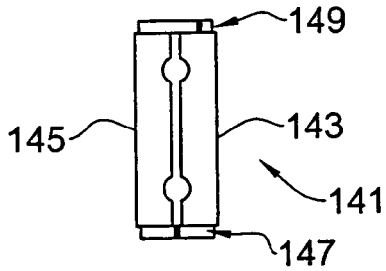
Figure 13A:
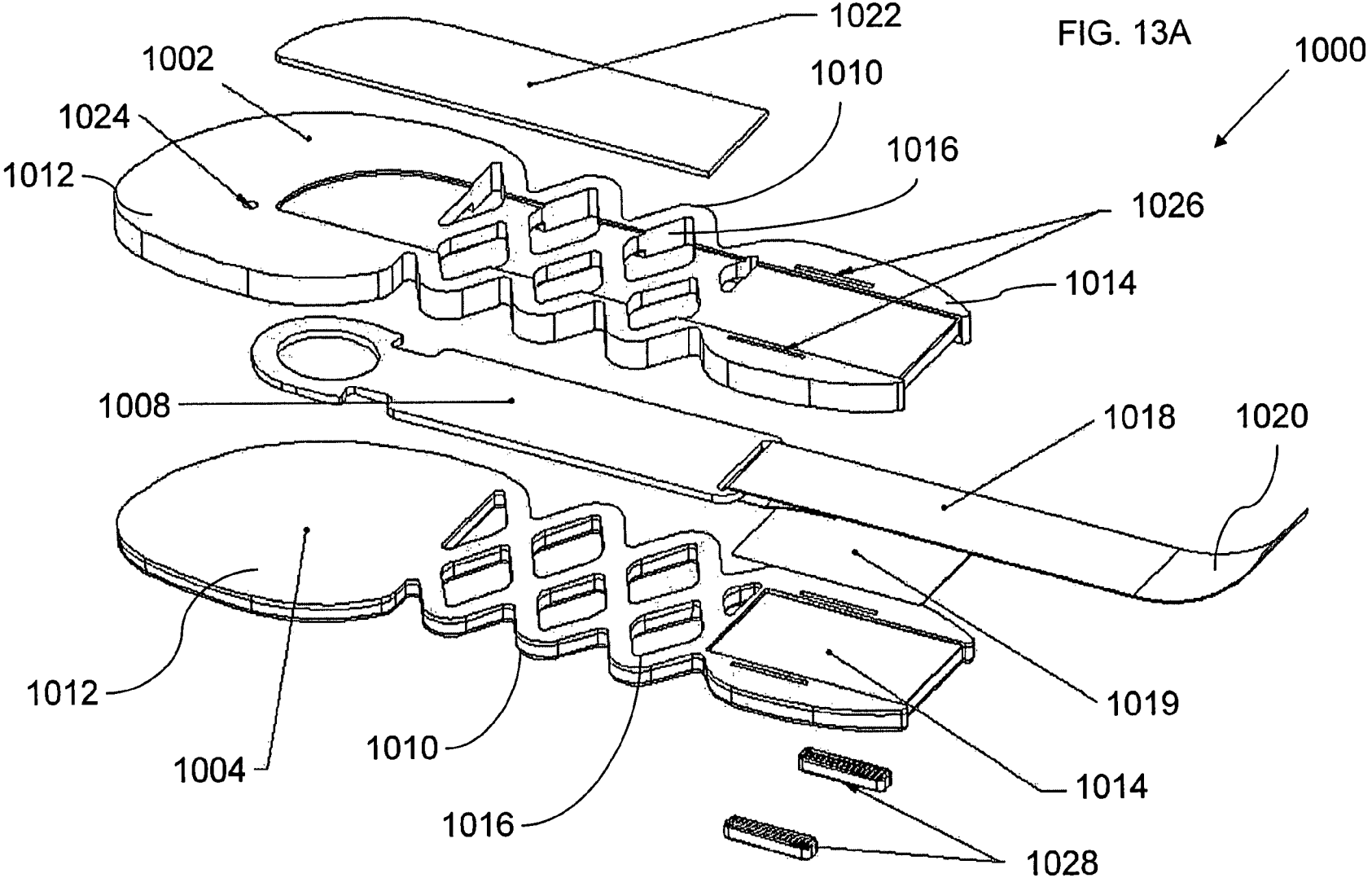
FIGS. 13A and 13B are upper and lower exploded isometric views, respectively, of a first variant of the embodiment of FIGS. 6 and 7.
Figure 13B:
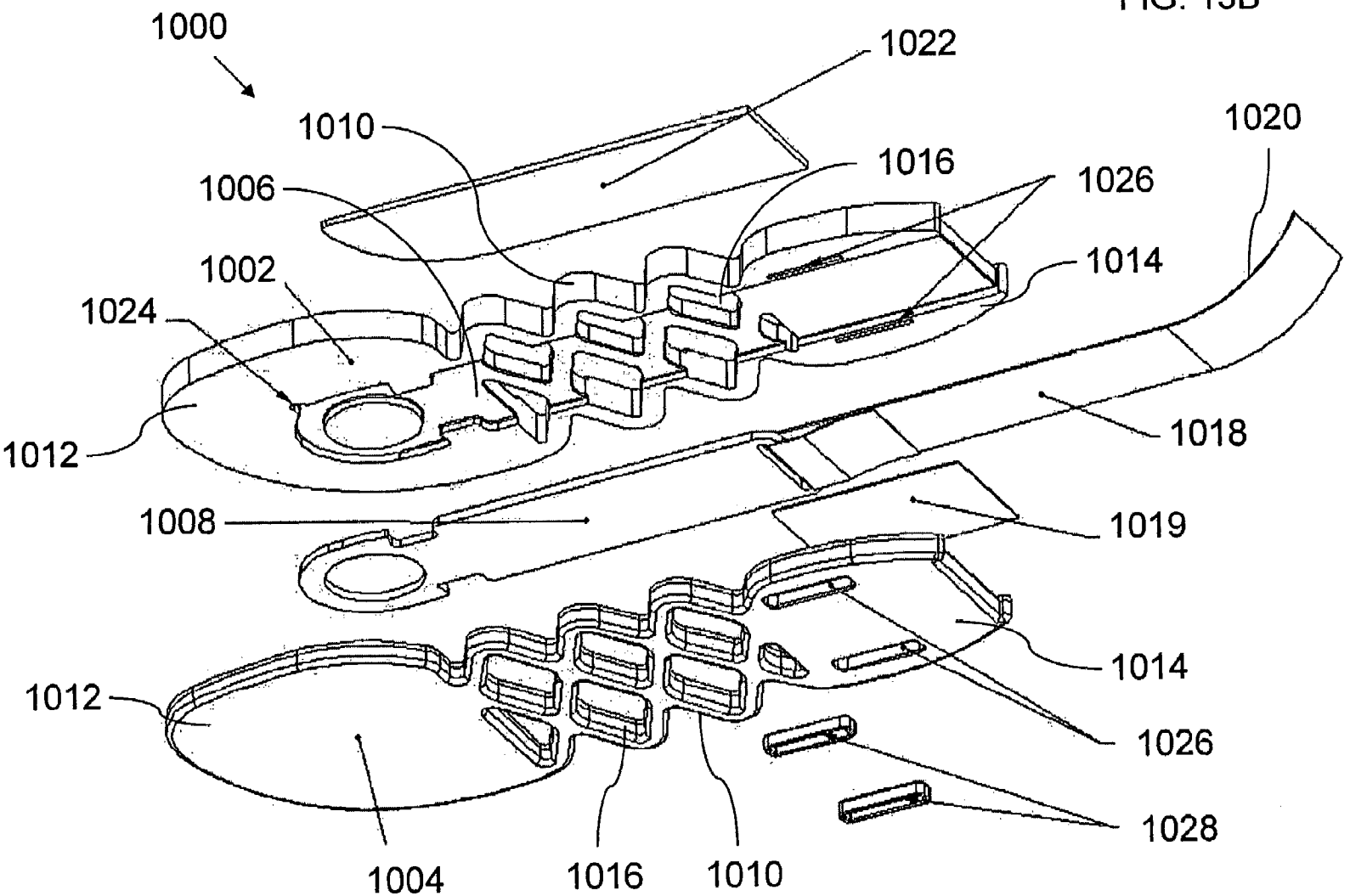
Figure 13C:
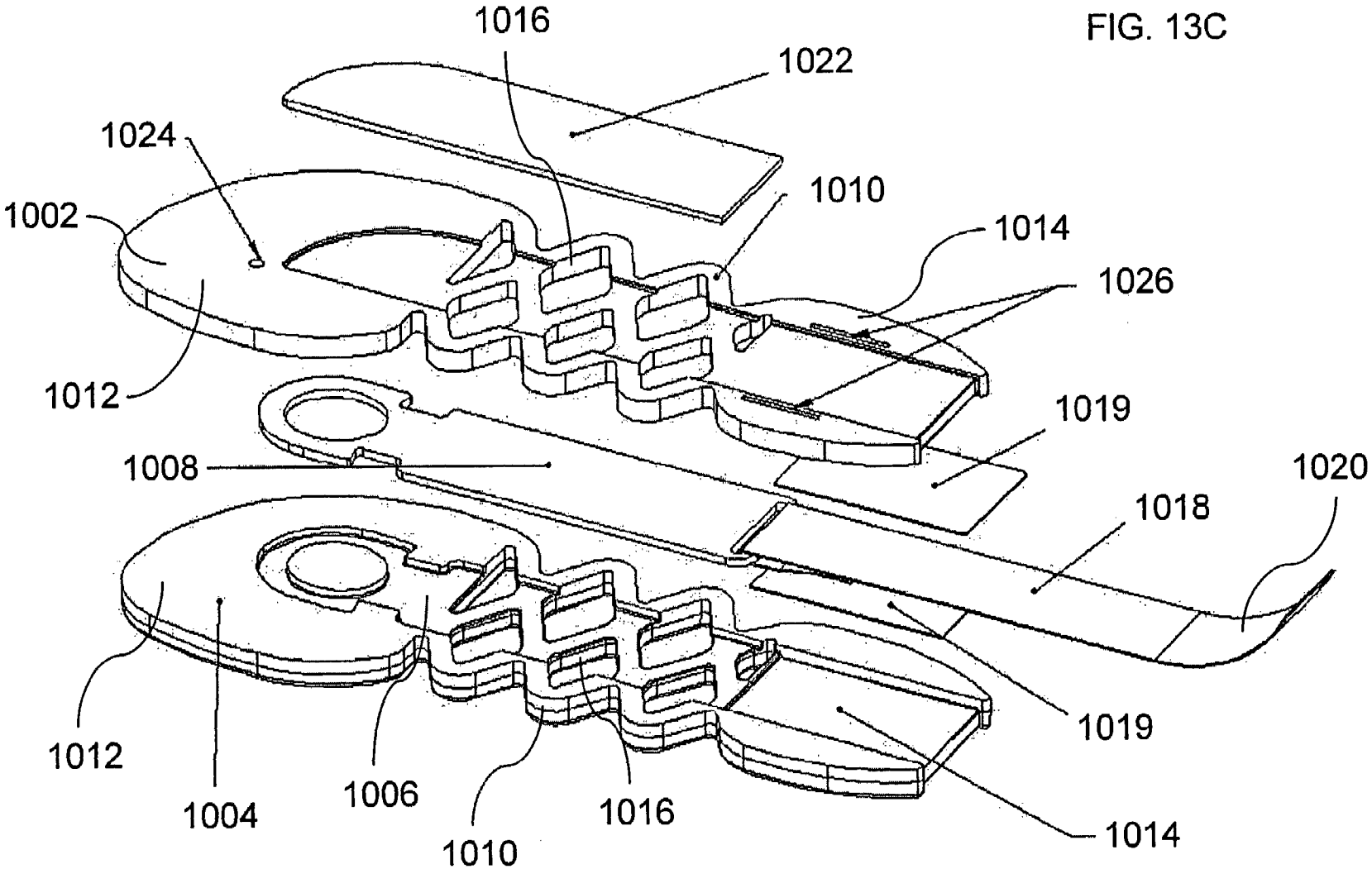
FIGS. 13C and 13D are upper and lower exploded isometric views of a slight variant of the implementation of FIGS. 13A and 13B.
Figure 13D:
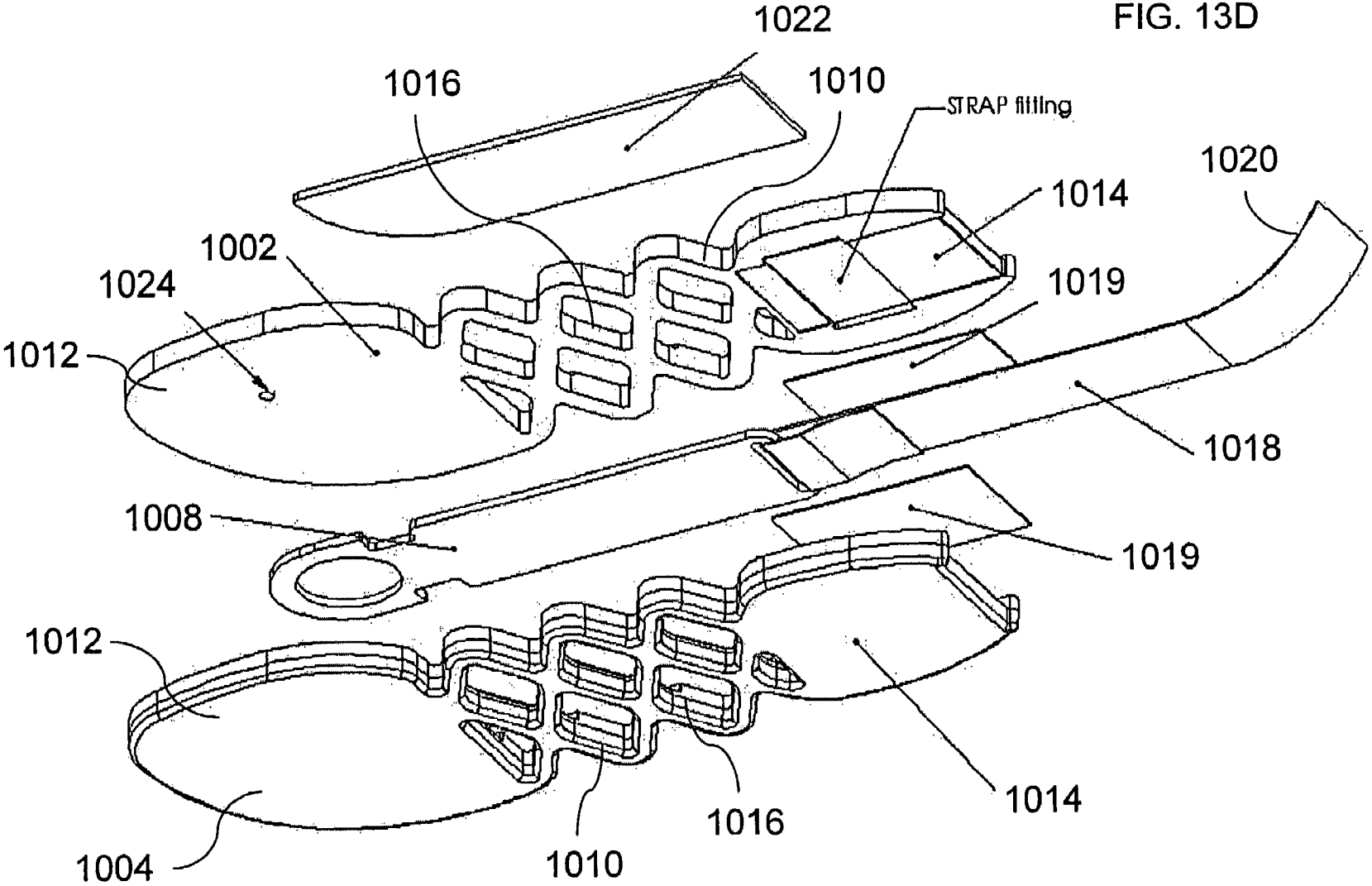
Figure 14B:
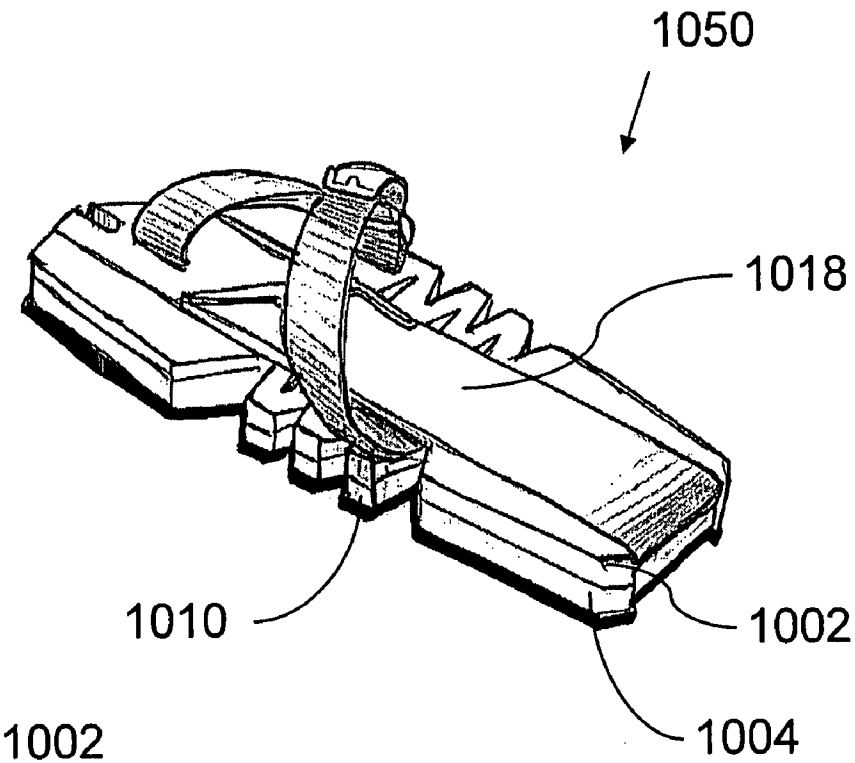
FIGS. 14A and 14B are isometric views of a second variant of the embodiment of FIGS. 6 and 7, shown in an elongated and shortened state, respectively.
Figure 14A:
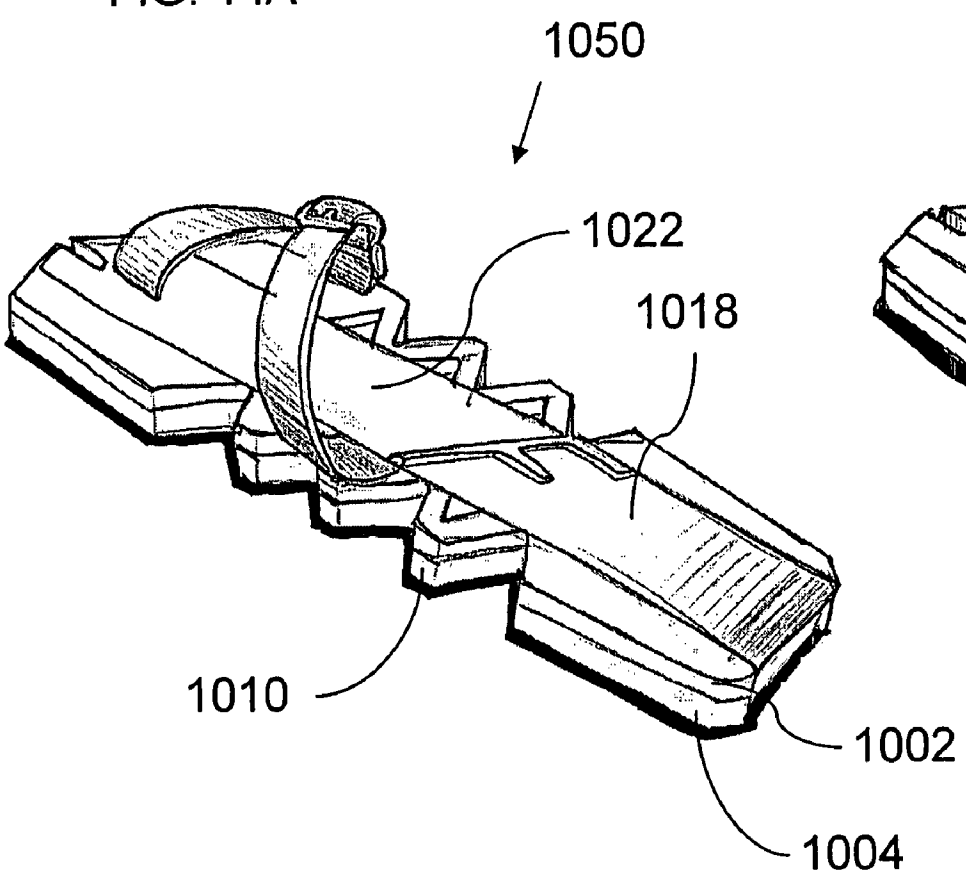
Figure 14C:
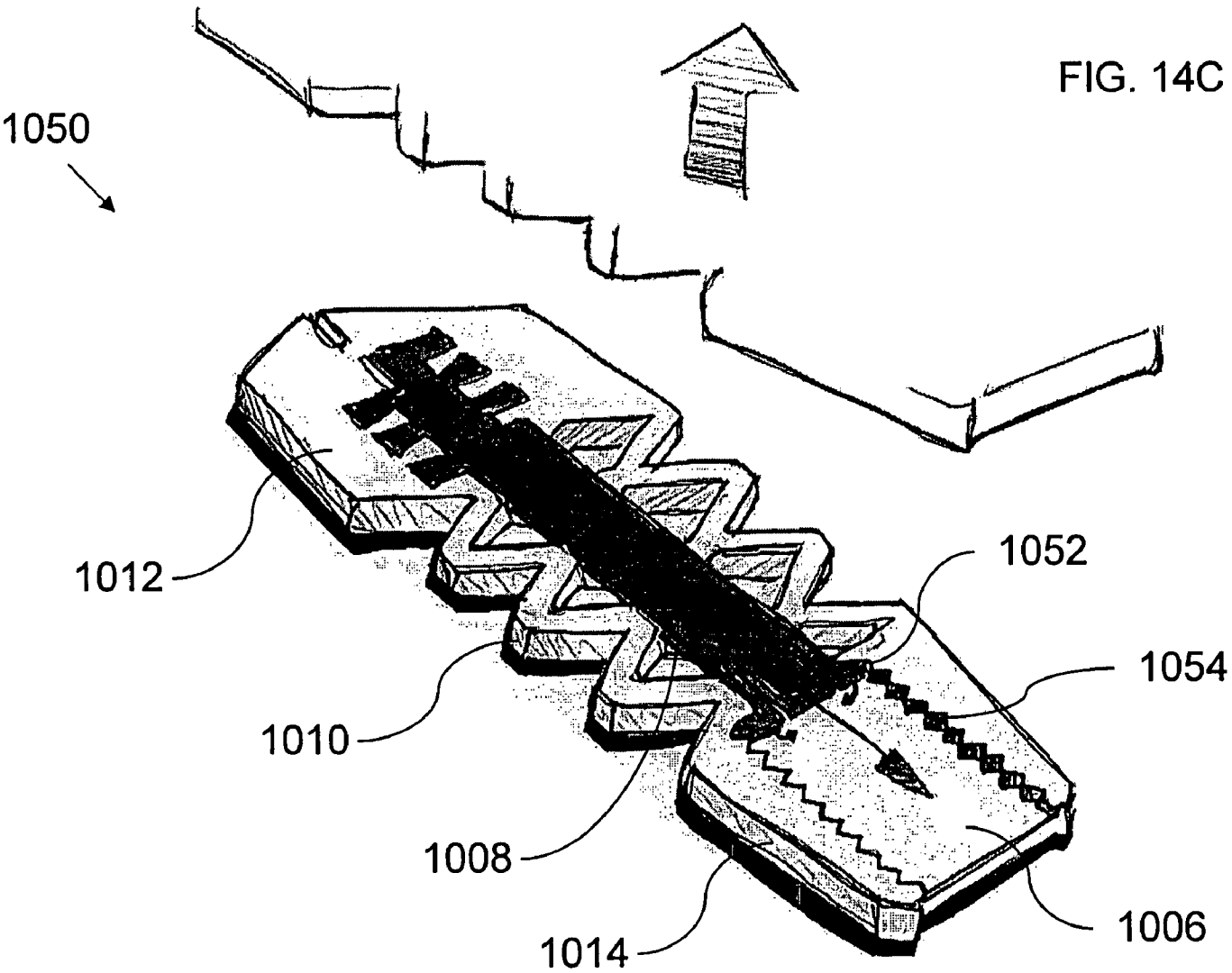
FIG. 14C is a partial exploded view of the implementation of FIG. 14A.
Figure 15B:
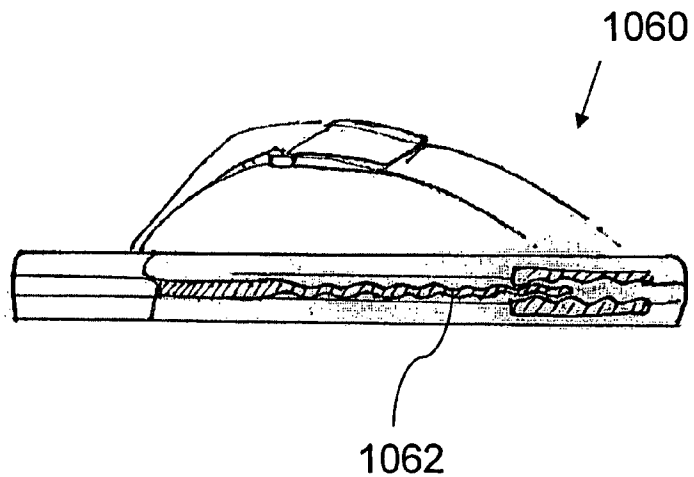
FIG. 15B is a longitudinal cross-sectional view taken through the implementation of FIG. 15A.
Figure 15A:
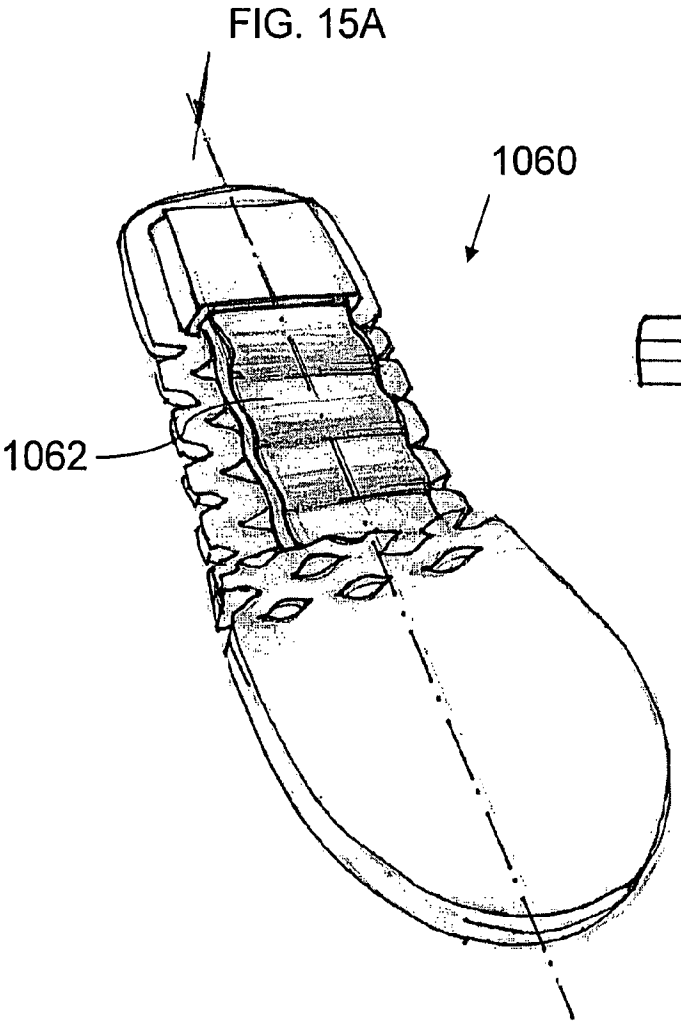
FIG. 15A is a partially cut-away lower isometric view of a third variant of the embodiment of FIGS. 6 and 7.
Figure 16B:
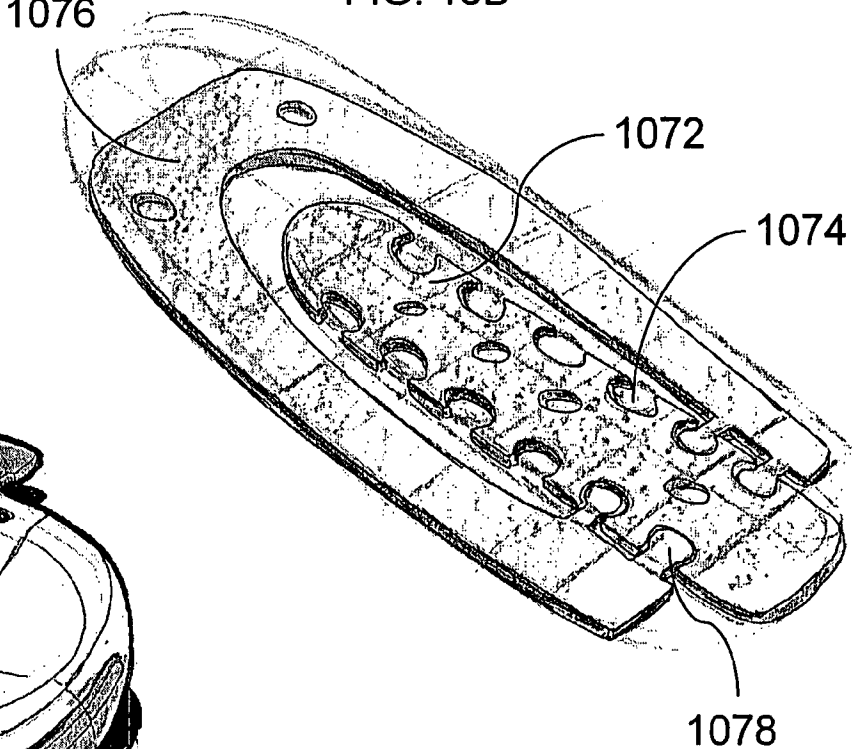
FIG. 16B is an isometric view of a retention mechanism from the implementation of FIG. 16A.
Figure 16A:
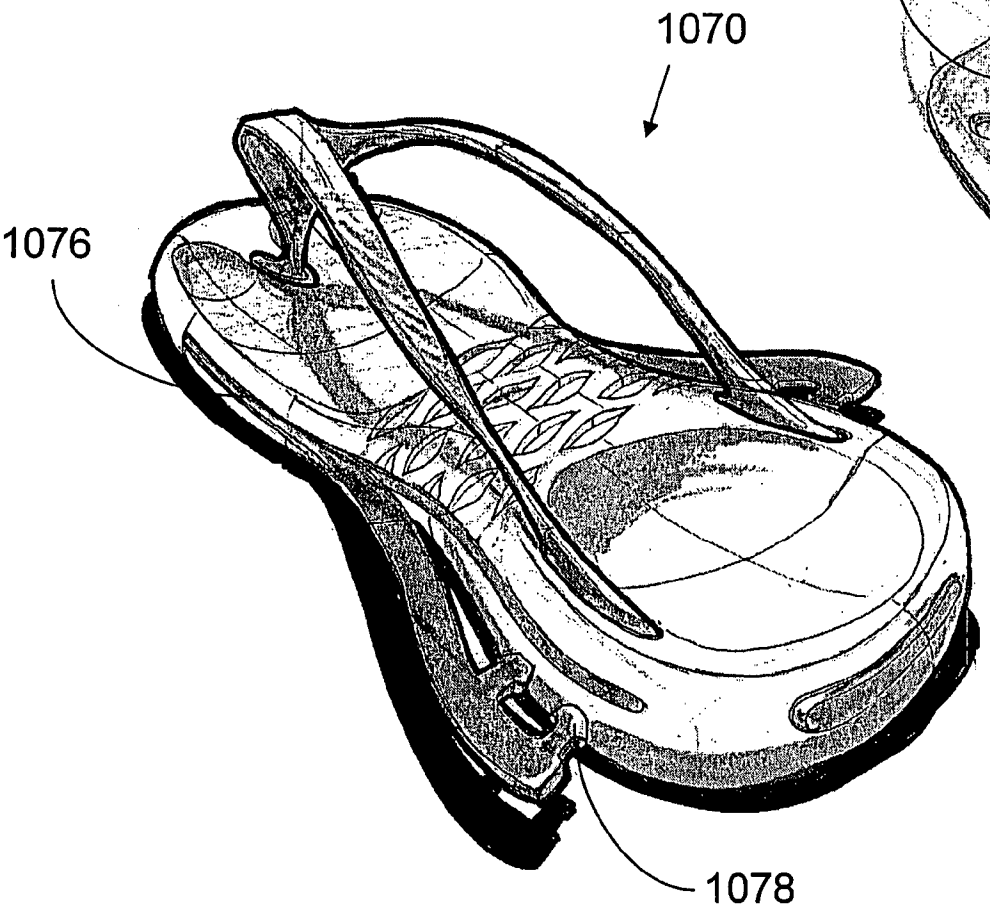
FIG. 16A is an isometric view of a fourth variant of the embodiment of FIGS. 6 and 7.
Figure 17B:
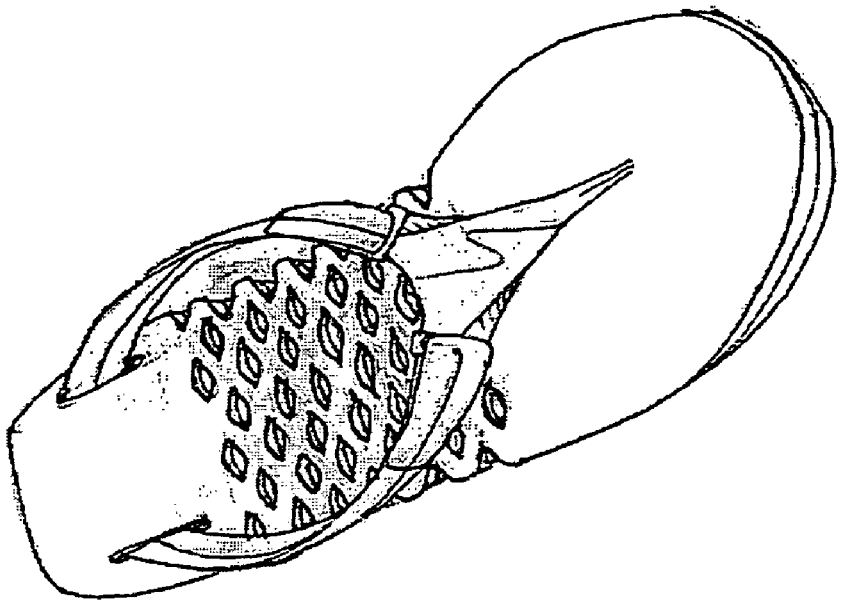
FIGS. 17A and 17B are isometric views illustrating a further optional form of openings for rendering an intermediate sole portion flexible for implementation of the present invention.
Figure 17A:
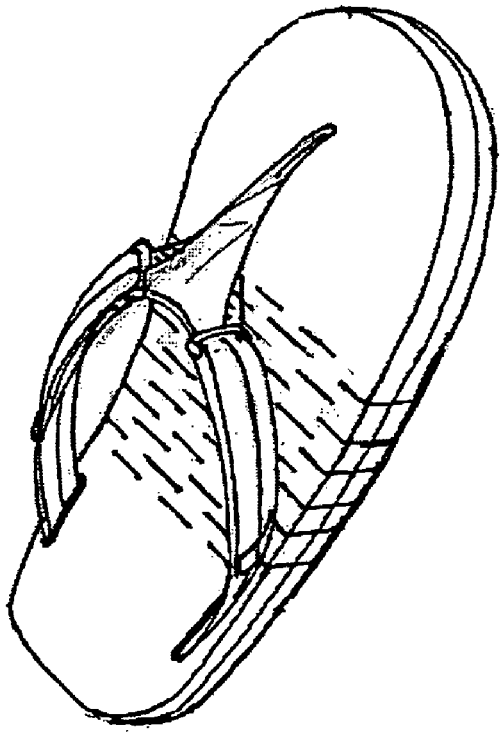
Figure 18:
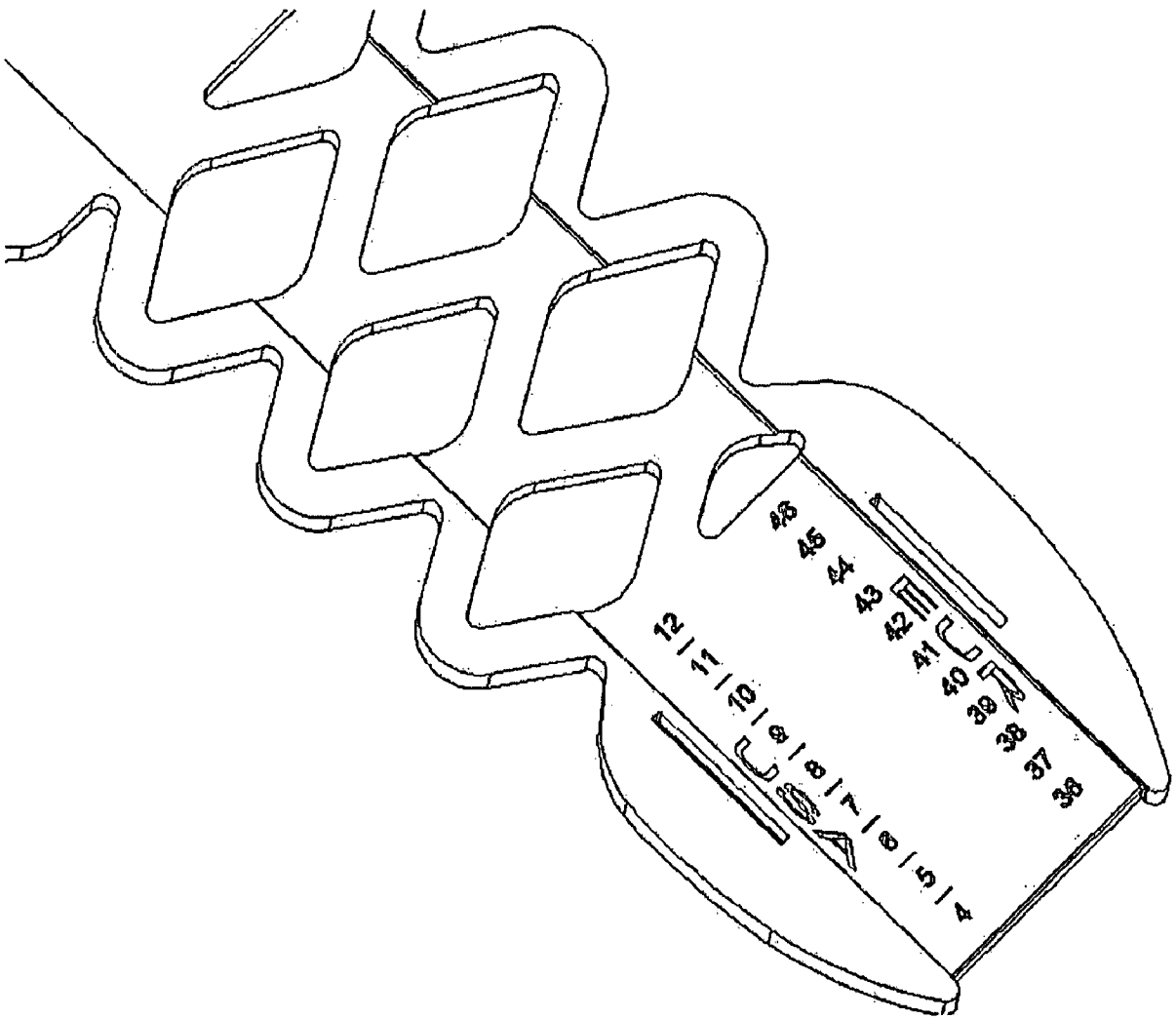
FIG. 18 is an isometric view of deployment of a set of size indicating indices for use in the above-referenced implementations according to a further feature of the present invention.

FIGS. 12A-12C provide some examples of segments which are suitable for use in the embodiment of FIG. 11. As such, FIG. 12A shows a segment 121 with one or more slits 123 adapted to allow the elastic member 117 to slide therealong the slits having a cavity 125 for holding the elastic member when the footwear 110 is assembled.

FIG. 12B shows a segment 131 having a transverse slit 133, the segment adapted to spread open whereby the elastic member 117 can be inserted or removed for adding or removing a segment, respectively.

FIG. 12C shows a segment 141 comprising two portions 143 and 145 held adjacent to each other by a hinge 147 at one end thereof and having a latch arrangement 149 at the other end thereof. To allow adding the segment 141 to the footwear 110, the segment can be opened by unlatching the latch arrangement 149 and pivoting the portions 143, 145 at the hinge 147 and fitting the segment around the elastic member 117. The reverse procedure is used to remove the segment 141 from the footwear 110.

It should be understood that segments such as segments 121, 131 and 141, and the like, can also be used in connection with the embodiment of FIG. 1.

It will be appreciated by persons skilled in the art that the present invention is not limited by what has been particularly shown by the exemplary embodiments described hereinabove. Thus, it should be understood that numerous additional embodiments are within the scope of the invention, mutatis mutandis.

For example, regarding the embodiment described with reference to FIGS. 1-5, the segments 16 and 16*b* need not be juxtaposed in an aligned manner and, for example, may be arranged in a fashion where they are staggered, angled, etc. thereby providing the wearer with different fashion options or individual expression. In this regard, it should be understood that the segments 16, 16*a* and 16*b* could be of a variety of shapes and colors and may comprise various ornamental features. Further, the bores 20 could be angled with respect to the heel/toe to facilitate assembly options for the footwear 10. Additionally, the segments 16, 16*a* and 16*b* could comprise a texture, for example, to provide a massaging effect to the wearer, for aesthetic purposes, for a combination of these, or for other purposes.

Further, the invention has been illustrated in relation to sandal type (i.e. so-called flip-flops or thongs), however, the invention also can embody footwear such as more conventional shoes and the like by incorporating known means for allowing the expansion/contraction of a footwear's upper portion (e.g. that described in the above-mentioned prior art).

In addition, it should be understood that features of the above embodiments may be combined or substituted for other features. For example, in connection to the embodiments described with reference to FIGS. 1-5, the segments 16, 16*a* and 16*b* may be held on a segment holding member being a tongue-like member, in place of the rods 18; and, those embodiments may incorporate locking mechanisms such as described with reference to FIGS. 6 and 10.

What is claimed is:

1. Personally adjustable footwear comprising:

(a) at least one sole layer including: a toe portion, a heel portion, and an intermediate portion, said intermediate portion being integrally formed with both said toe portion and said heel portion, said intermediate portion having a plurality of openings passing substantially vertically through said sole layer deployed to provide a latticework pattern as viewed from above so that said intermediate portion is elastically flexible to allow relative longitudinal displacement of said toe portion and said heel portion to vary a length of said sole layer without significant variation in a thickness of said sole layer; and (b) a retention mechanism associated with both said toe portion and said heel portion, said retention mechanism being configured for retaining any of a plurality of relative positions between said toe portion and said heel portion.

2. The footwear of claim 1, wherein said toe portion, said heel portion and said intermediate portion are all integrally formed from a uniform composition.

3. The footwear of claim 1, wherein said at least one sole layer has an upper surface providing a foot support, wherein said plurality or openings are configured to have a maximum open longitudinal dimension no greater than about 2.5 centimeters so as to provide near-continuous foot support.

4. The footwear of claim 1, wherein said at least one sole layer is implemented as at least two sole layers including a lower sole layer having a bottom surface configured for ground engagement and an upper sole layer including an upper surface for supporting a foot.

5. The footwear of claim 4, wherein said upper sole layer is formed from a material softer than said lower sole layer.

6. The footwear of claim 4, wherein said lower sole layer and said upper sole layer are shaped to define therebetween at least one longitudinal channel extending longitudinally between said toe portions and said heel portions, and wherein said retention mechanism includes an element deployed within said channel, said element being anchored to a first of said toe portion and said heel portion and being displaceable relative to the second of said toe portion and said heel portion.

7. The footwear of claim 1, wherein said sole layer forms at least part of a sole arrangement, said sole arrangement including at least one longitudinal channel extending longitudinally between said toe portion and said heel portion, and wherein said retention mechanism includes an element deployed within said channel, said element being anchored to a first of said toe portion and said heel portion and being displaceable relative to the second of said toe portion and said heel portion.

8. The footwear of claim 7, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions.

9. The footwear of claim 8, wherein said intermediate portion is resiliently biased to separate said toe portion and said heel portion to a predefined relative position corresponding to a maximum length of said sole arrangement, and wherein said retention mechanism further includes:

(a) a flexible strap associated with said element and extending from said sole arrangement such that tension applied to said flexible strap relative to said second of said toe and said heel portions draws together said toe portion and said heel portion, thereby shortening said length of said sole arrangement; and (b) a locking arrangement for locking said flexible strap in a plurality of positions, thereby retaining said sole arrangement at a desired length.

10. The footwear of claim 7, wherein said intermediate portion is resiliently biased to separate said toe portion and said heel portion to a predefined relative position corresponding to a maximum length of said sole arrangement, and wherein said retention mechanism further includes:

(a) a flexible strap associated with said element and extending from said sole arrangement such that tension applied to said flexible strap relative to said second of said toe and said heel portions draws together said toe portion and said heel portion, thereby shortening a length of said sole arrangement; and (b) a locking arrangement for locking said flexible strap in a plurality of positions, thereby retaining said sole arrangement at a desired length.

11. The footwear of claim 10, wherein said locking arrangement includes a first part of a hook-and-loop fastener associated with an end portion of said flexible strap and a complementary part of a hook-and-loop fastener associated with an upward-facing surface of said sole arrangement such that said flexible strap is folded onto said upward-facing surface to lock said sole arrangement at a desired length.

12. The footwear of claim 7, wherein said retention mechanism further includes a manually releasable and manually engagable locking mechanism for locking a position of said element relative to said second of said toe portion and said heel portion.

13. The footwear of claim 1, wherein said retention mechanism includes a manually releasable and manually engagable locking mechanism for locking a relative position of said toe portion and said heel portion.

14. A personally adjustable sandal comprising:

(a) at least one sole layer having an upper surface for supporting a user's foot and a bottom surface for ground engagement including: a toe portion, a heel portion, and an intermediate portion, said intermediate portion being integrally formed with both said toe portion and said heel portion, said intermediate portion having a plurality of openings passing substantially vertically through said sole layer from the upper surface to the bottom surface deployed to provide a latticework pattern as viewed from above so that said intermediate portion is elastically flexible to allow relative longitudinal displacement of said toe portion and said heel portion to vary a length of said sole layer without significant variation in a thickness of said sole layer; and (b) a retention mechanism associated with both said toe portion and said heel portion, said retention mechanism being configured for retaining any of a plurality of relative positions between said toe portion and said heel portion.

15. The sandal of claim 14, wherein said toe portion, said heel portion and said intermediate portion are all integrally formed from a uniform composition.

16. The sandal of claim 14, wherein said plurality or openings are configured to have a maximum open longitudinal dimension no greater than about 2.5 centimeters so as to provide near-continuous foot support.

17. The sandal of claim 14, wherein said at least one sole layer is implemented as at least two sole layers including a lower sole layer forming the bottom surface configured for ground engagement and an upper sole layer forming the upper surface for supporting a foot.

18. The sandal of claim 17, wherein said upper sole layer is formed from a material softer than said lower sole layer.

19. The sandal of claim 17, wherein said lower sole layer and said upper sole layer are shaped to define therebetween at least one longitudinal channel extending longitudinally between said toe portions and said heel portions, and wherein said retention mechanism includes an element deployed within said channel, said element being anchored to a first of said toe portion and said heel portion and being displaceable relative to the second of said toe portion and said heel portion.

20. The sandal of claim 14, wherein said sole layer forms at least part of a sole arrangement, said sole arrangement including at least one longitudinal channel extending longitudinally between said toe portion and said heel portion, and wherein said retention mechanism includes an element deployed within said channel, said element being anchored to a first of said toe portion and said heel portion and being displaceable relative to the second of said toe portion and said heel portion.

21. The sandal of claim 20, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions.

22. The sandal of claim 21, wherein said intermediate portion is resiliently biased to separate said toe portion and said heel portion to a predefined relative position corresponding to a maximum length of said sole arrangement, and wherein said retention mechanism further includes:

(a) a flexible strap associated with said element and extending from said sole arrangement such that tension applied to said flexible strap relative to said second of said toe and said heel portions draws together said toe portion and said heel portion, thereby shortening said length of said sole arrangement; and (b) a locking arrangement for locking said flexible strap in a plurality of positions, thereby retaining said sole arrangement at a desired length.

23. The sandal of claim 20, wherein said retention mechanism further includes a manually releasable and manually engagable locking mechanism for locking a position of said element relative to said second of said toe portion and said heel portion.

24. The sandal of claim 14, wherein said retention mechanism includes a manually releasable and manually engagable locking mechanism for locking a relative position of said toe portion and said heel portion.

25. Personally adjustable footwear comprising:

(a) at least one sole layer including: a toe portion, a heel portion, and an intermediate portion, said intermediate portion being integrally formed with both said toe portion and said heel portion, said intermediate portion having a plurality of openings passing substantially vertically through said sole layer so that said intermediate portion is elastically flexible to allow relative longitudinal displacement of said toe portion and said heel portion to vary a length of said sole layer without significant variation in a thickness of said sole layer, wherein said at least one sole layer is implemented as at least two sole layers including a lower sole layer having a bottom surface configured for ground engagement and an upper sole layer including an upper surface for supporting a foot, said lower sole layer and said upper sole layer shaped to define therebetween at least one longitudinal channel extending longitudinally between said toe portion and said heel portion; and (b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion.

26. The footwear of claim 25, wherein said toe portion, said heel portion and said intermediate portion are all integrally formed from a uniform composition.

27. The footwear of claim 25, wherein said at least one sole layer has an upper surface providing a foot support, wherein said plurality or openings are configured to have a maximum open longitudinal dimension no greater than about 2.5 centimeters so as to provide near-continuous foot support.

28. The footwear of claim 25, wherein said upper sole layer is formed from a material softer than said lower sole layer.

29. The footwear of claim 25, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions.

30. The footwear of claim 29, wherein said intermediate portion is resiliently biased to separate said toe portion and said heel portion to a predefined relative position corresponding to a maximum length of said sole arrangement, and wherein said retention mechanism further includes:

(a) a flexible strap associated with said element and extending from said sole arrangement such that tension applied to said flexible strap relative to said second of said toe and said heel portions draws together said toe portion and said heel portion, thereby shortening said length of said sole arrangement; and (b) a locking arrangement for locking said flexible strap in a plurality of positions, thereby retaining said sole arrangement at a desired length.

31. The footwear of claim 25, wherein said retention mechanism further includes a manually releasable and manually engagable locking mechanism for locking a position of said element relative to said second of said toe portion and said heel portion.

32. The footwear of claim 25, wherein said retention mechanism includes a manually releasable and manually engagable locking mechanism for locking a relative position of said toe portion and said heel portion.

33. A personally adjustable sandal comprising:

(a) at least one sole layer having an upper surface for supporting a user's foot and a bottom surface for ground engagement including: a toe portion, a heel portion, and an intermediate portion, said intermediate portion being integrally formed with both said toe portion and said heel portion, said intermediate portion having a plurality of openings passing substantially vertically through said sole layer from the upper surface to the bottom surface so that said intermediate portion is elastically flexible to allow relative longitudinal displacement of said toe portion and said heel portion to vary a length of said sole layer without significant variation in a thickness of said sole layer, wherein said at least one sole layer is implemented as at least two sole layers including a lower sole layer forming the bottom surface configured for ground engagement and an upper sole layer forming the upper surface for supporting a foot, said lower sole layer and said upper sole layer shaped to define therebetween at least one longitudinal channel extending longitudinally between said toe portion and said heel portion; and (b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion.

34. The footwear of claim 33, wherein said toe portion, said heel portion and said intermediate portion are all integrally formed from a uniform composition.

35. The footwear of claim 33, wherein said at least one sole layer has an upper surface providing a foot support, wherein said plurality or openings are configured to have a maximum open longitudinal dimension no greater than about 2.5 centimeters so as to provide near-continuous foot support.

36. The footwear of claim 33, wherein said upper sole layer is formed from a material softer than said lower sole layer.

37. The footwear of claim 33, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions.

38. The footwear of claim 37, wherein said intermediate portion is resiliently biased to separate said toe portion and said heel portion to a predefined relative position corresponding to a maximum length of said sole arrangement, and wherein said retention mechanism further includes:

(a) a flexible strap associated with said element and extending from said sole arrangement such that tension applied to said flexible strap relative to said second of said toe and said heel portions draws together said toe portion and said heel portion, thereby shortening said length of said sole arrangement; and (b) a locking arrangement for locking said flexible strap in a plurality of positions, thereby retaining said sole arrangement at a desired length.

39. The footwear of claim 33, wherein said retention mechanism further includes a manually releasable and manually engagable locking mechanism for locking a position of said element relative to said second of said toe portion and said heel portion.

40. The footwear of claim 33, wherein said retention mechanism includes a manually releasable and manually engagable locking mechanism for locking a relative position of said toe portion and said heel portion.

41. Personally adjustable footwear comprising:

(a) at least one sole layer including: a toe portion, a heel portion, and an intermediate portion, said intermediate portion being integrally formed with both said toe portion and said heel portion, said intermediate portion having a plurality of openings passing substantially vertically through said sole layer so that said intermediate portion is elastically flexible to allow relative longitudinal displacement of said toe portion and said heel portion to vary a length of said sole layer without significant variation in a thickness of said sole layer, wherein said sole layer forms at least part of a sole arrangement, said sole arrangement including at least one longitudinal channel extending longitudinally between said toe portion and said heel portion, and further wherein said intermediate portion is resiliently biased to separate said toe portion and said heel portion to a predefined relative position corresponding to a maximum length of said sole arrangement; and (b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion, and further wherein said retention mechanism includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions, and wherein said retention mechanism further includes:

(i) a flexible strap associated with said element and extending from said sole arrangement such that tension applied to said flexible strap relative to said second of said toe and said heel portions draws together said toe portion and said heel portion, thereby shortening said length of said sole arrangement; and (ii) a locking arrangement for locking said flexible strap in a plurality of positions, thereby retaining said sole arrangement at a desired length.

A personally adjustable sandal comprising:

(a) at least one sole layer having an upper surface for supporting a user's foot and a bottom surface for ground engagement including: a toe portion, a heel portion, and an intermediate portion, said intermediate portion being integrally formed with both said toe portion and said heel portion, said intermediate portion having a plurality of openings passing substantially vertically through said sole layer from the upper surface to the bottom surface so that said intermediate portion is elastically flexible to allow relative longitudinal displacement of said toe portion and said heel portion to vary a length of said sole layer without significant variation in a thickness of said sole layer, wherein said sole layer forms at least part of a sole arrangement, said sole arrangement including at least one longitudinal channel extending longitudinally between said toe portion and said heel portion, and further wherein said intermediate portion is resiliently biased to separate said toe portion and said heel portion to a predefined relative position corresponding to a maximum length of said sole arrangement; and (b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion, and further wherein said retention mechanism includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions, and wherein said retention mechanism further includes:

(i) a flexible strap associated with said element and extending from said sole arrangement such that tension applied to said flexible strap relative to said second of said toe and said heel portions draws together said toe portion and said heel portion, thereby shortening said length of said sole arrangement; and (ii) a locking arrangement for locking said flexible strap in a plurality of positions, thereby retaining said sole arrangement at a desired length.

42. A personally adjustable sandal comprising:

(a) at least one sole layer having an upper surface for supporting a user's foot and a bottom surface for ground engagement including: a toe portion, a heel portion, and an intermediate portion, said intermediate portion being integrally formed with both said toe portion and said heel portion, said intermediate portion having a plurality of openings passing substantially vertically through said sole layer from the upper surface to the bottom surface so that said intermediate portion is elastically flexible to allow relative longitudinal displacement of said toe portion and said heel portion to vary a length of said sole layer without significant variation in a thickness of said sole layer, wherein said sole layer forms at least part of a sole arrangement, said sole arrangement including at least one longitudinal channel extending longitudinally between said toe portion and said heel portion, and further wherein said intermediate portion is resiliently biased to separate said toe portion and said heel portion to a predefined relative position corresponding to a maximum length of said sole arrangement; and (b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion, and further wherein said retention mechanism includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole arrangement is manually adjustable by manual application of force to overcome said resistive force, and such that, in the absence of manually applied force, said toe portion and said heel portion are retained in one of said predefined relative positions, and wherein said retention mechanism further includes:

(i) a flexible strap associated with said element and extending from said sole arrangement such that tension applied to said flexible strap relative to said second of said toe and said heel portions draws together said toe portion and said heel portion, thereby shortening said length of said sole arrangement; and (ii) a locking arrangement for locking said flexible strap in a plurality of positions, thereby retaining said sole arrangement at a desired length.

* * * * *